US012677931B2

(12) United States Patent
Alsberg et al.

(10) Patent No.: US 12,677,931 B2
(45) Date of Patent: Jul. 14, 2026

(54) CLEANING ASSEMBLY

(71) Applicant: The Clorox Company, Oakland, CA (US)

(72) Inventors: Keith Alsberg, Chicago, IL (US); Russell E. Bell, Pleasanton, CA (US); Benjamin Ma, Pleasanton, CA (US); Julia Byrne, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 611 days.

(21) Appl. No.: 17/590,646

(22) Filed: Feb. 1, 2022

(65) Prior Publication Data

US 2023/0240435 A1 Aug. 3, 2023

(51) Int. Cl.

| | |
|---|---|
| ***A46B 5/00*** | (2006.01) |
| ***A47K 11/10*** | (2006.01) |
| ***A47L 13/46*** | (2006.01) |

(52) U.S. Cl.

CPC ..... *A46B 5/0095* (2013.01); *A47K 11/10* (2013.01); *A47L 13/46* (2013.01); *A46B 2200/304* (2013.01)

(58) Field of Classification Search

CPC ... A46B 5/0095; A46B 5/00; A46B 2200/304; A46B 5/002; A46B 5/0025; A46B 5/0029; A46B 5/0041; A46B 5/0054; A46B 5/0058; A46B 5/0075; A46B 5/0083; A46B 5/0079; A46B 5/0087; A47K 11/10; A47K 17/00; A47L 13/46; A47L 13/257

See application file for complete search history.

(56) References Cited

U.S. PATENT DOCUMENTS

| | | | | |
|---|---|---|---|---|
| 1,124,073 A | | 1/1915 | Sullivan | |
| 1,779,057 A | | 10/1930 | Tolmach | |
| 2,428,306 A | | 9/1947 | Beagle | |
| 2,752,625 A | * | 7/1956 | Ponsell | A47L 13/022 15/154 |
| 2,764,774 A | | 10/1956 | Belsky et al. | |
| 3,214,779 A | | 11/1965 | Wheeler | |
| 3,256,075 A | | 6/1966 | Myron et al. | |
| 4,457,038 A | | 7/1984 | Hammond | |
| 4,466,152 A | | 8/1984 | Moss et al. | |

(Continued)

FOREIGN PATENT DOCUMENTS

| | | |
|---|---|---|
| EP | 313495 A1 | 4/1989 |
| EP | 1254950 A2 | 6/2002 |

(Continued)

OTHER PUBLICATIONS

International Search Report and Written Opinion regarding International Patent Application No. PCT/US2023/011939, dated Apr. 12, 2023.

(Continued)

*Primary Examiner* — Monica S Carter
*Assistant Examiner* — Kent N Shum
(74) *Attorney, Agent, or Firm* — Harness, Dickey & Pierce, P.L.C.

(57) ABSTRACT

Disclosed is a cleaning assembly having a handle and head portion. The head portion may be coupled to the handle portion. The coupling or engagement may include a fitment formed on or with the head portion and a collet assembly provided with a handle portion.

21 Claims, 14 Drawing Sheets

(56) References Cited

U.S. PATENT DOCUMENTS

| | | | | |
|---|---|---|---|---|
| 4,493,124 | A | 1/1985 | Agapiou | |
| 4,642,836 | A | 2/1987 | Bokmiller | |
| 4,663,796 | A | 5/1987 | Helling et al. | |
| 4,796,325 | A | 1/1989 | Bortman | |
| 4,852,201 | A | 8/1989 | Wundrock et al. | |
| 4,987,634 | A | 1/1991 | Weihrauch | |
| 5,381,809 | A | 1/1995 | Parker, Jr. | |
| 5,407,594 | A | 4/1995 | Fry et al. | |
| 5,410,771 | A | 5/1995 | Bereza | |
| 5,471,697 | A | 12/1995 | Daconta | |
| 5,551,115 | A | 9/1996 | Newville | |
| 5,630,243 | A | 5/1997 | Federico et al. | |
| 5,642,913 | A * | 7/1997 | Brown | A45D 29/007 132/73 |
| 5,658,874 | A | 8/1997 | Davies et al. | |
| 5,842,810 | A | 12/1998 | Morad | |
| 5,862,565 | A | 1/1999 | Lundstedt | |
| 5,888,002 | A | 3/1999 | Fenstersheib | |
| 5,941,379 | A | 8/1999 | Barardo | |
| 5,945,076 | A | 8/1999 | Leonard et al. | |
| D413,470 | S | 9/1999 | Burton | |
| 6,094,771 | A | 8/2000 | Egolf et al. | |
| 6,154,913 | A | 12/2000 | Burton | |
| 6,191,100 | B1 | 2/2001 | Askew et al. | |
| RE37,190 | E | 5/2001 | Stowell et al. | |
| 6,295,688 | B1 | 10/2001 | Sayles et al. | |
| 6,313,086 | B1 | 11/2001 | Askew et al. | |
| 6,355,607 | B1 | 3/2002 | Rahman et al. | |
| 6,405,403 | B1 | 6/2002 | McKay | |
| 6,413,928 | B1 | 7/2002 | Painter et al. | |
| 6,426,111 | B1 | 7/2002 | Hirsch | |
| 6,523,213 | B1 | 2/2003 | Post | |
| 6,611,986 | B1 | 9/2003 | Seals | |
| D496,586 | S | 9/2004 | Belser et al. | |
| D501,728 | S | 2/2005 | Conway et al. | |
| D502,002 | S | 2/2005 | Conway et al. | |
| D502,324 | S | 3/2005 | Conway et al. | |
| D504,065 | S | 4/2005 | Belser et al. | |
| 6,978,508 | B2 | 12/2005 | Young | |
| D520,852 | S | 5/2006 | Minkler et al. | |
| 7,059,008 | B2 | 6/2006 | Morgan et al. | |
| 7,065,825 | B2 | 6/2006 | Minkler et al. | |
| 7,127,768 | B2 | 10/2006 | Blum et al. | |
| D532,564 | S | 11/2006 | Neumann et al. | |
| 7,146,676 | B2 | 12/2006 | Kubes et al. | |
| 7,159,265 | B2 | 1/2007 | Soller et al. | |
| 7,213,706 | B2 | 5/2007 | Belser et al. | |
| 7,275,276 | B2 | 10/2007 | Jaszenovics et al. | |
| 7,316,046 | B2 | 1/2008 | Michaels et al. | |
| 7,344,553 | B2 * | 3/2008 | Opolski | A61B 34/71 606/205 |
| 7,386,910 | B2 | 6/2008 | Minkler et al. | |
| 7,446,082 | B2 | 11/2008 | Kilkenny et al. | |
| 7,470,652 | B2 | 12/2008 | Kilkenny et al. | |
| 7,530,138 | B1 * | 5/2009 | Platt | A46B 9/005 15/210.1 |
| 7,533,437 | B1 | 5/2009 | Gartner | |
| 7,603,739 | B2 | 10/2009 | Minkler et al. | |
| 8,015,653 | B2 | 9/2011 | Bargiel et al. | |
| 8,286,295 | B2 | 10/2012 | Minkler et al. | |
| 8,888,395 | B1 | 11/2014 | Hinnant | |
| 9,021,649 | B2 | 5/2015 | Minkler et al. | |
| 9,237,939 | B2 * | 1/2016 | Maurer | A61C 3/10 |
| 9,655,482 | B2 | 5/2017 | Michelson et al. | |
| 10,264,941 | B2 | 4/2019 | Koval et al. | |
| 10,932,646 | B2 | 3/2021 | Weaver et al. | |
| 11,253,127 | B2 | 2/2022 | Yan | |
| 2002/0007527 | A1 | 1/2002 | Hart | |
| 2002/0032137 | A1 | 3/2002 | DeSenna et al. | |
| 2002/0061831 | A1 | 5/2002 | Kaziska et al. | |
| 2002/0083542 | A1 | 7/2002 | Hart | |
| 2002/0173442 | A1 | 11/2002 | Smith et al. | |
| 2004/0088808 | A1 | 5/2004 | Vitantonio et al. | |
| 2004/0255418 | A1 | 12/2004 | Minkler et al. | |
| 2005/0005378 | A1 | 1/2005 | Soller et al. | |
| 2005/0055787 | A1 | 3/2005 | Blum et al. | |
| 2005/0066465 | A1 | 3/2005 | Minkler et al. | |
| 2005/0246849 | A1 | 11/2005 | Minkler et al. | |
| 2007/0006412 | A1 | 1/2007 | Soller et al. | |
| 2007/0094827 | A1 | 5/2007 | Kilkenny et al. | |
| 2009/0152132 | A1 | 6/2009 | Wang | |
| 2009/0159487 | A1 * | 6/2009 | Tacoma | B25J 1/04 15/210.1 |
| 2012/0216831 | A1 | 8/2012 | Cobabe et al. | |
| 2014/0157535 | A1 | 6/2014 | Minkler et al. | |
| 2018/0132678 | A1 | 5/2018 | Farrow et al. | |
| 2020/0163447 | A1 * | 5/2020 | Spitaletta | A46B 9/025 |
| 2021/0052117 | A1 | 2/2021 | O'Brien et al. | |
| 2021/0137325 | A1 * | 5/2021 | Hersey | A47K 11/10 |
| 2022/0232960 | A1 | 7/2022 | Brown et al. | |
| 2022/0233035 | A1 | 7/2022 | Brown et al. | |

FOREIGN PATENT DOCUMENTS

| | | | |
|---|---|---|---|
| JP | H09135728 | A | 5/1997 |
| JP | H10295610 | A | 11/1998 |
| WO | 8700411 | A1 | 1/1987 |
| WO | 0034422 | A2 | 6/2000 |
| WO | 0071012 | A1 | 11/2000 |
| WO | 0115587 | A1 | 3/2001 |
| WO | 0126499 | A1 | 4/2001 |
| WO | 0130954 | A1 | 5/2001 |
| WO | 0143618 | A1 | 6/2001 |
| WO | 0149818 | A1 | 7/2001 |
| WO | 2005006933 | A2 | 1/2005 |
| WO | 2020251464 | A1 | 12/2020 |

OTHER PUBLICATIONS

International Preliminary Report on Patentability regarding International Patent Application No. PCT/US2023/011939, dated Aug. 6, 2024, 10 pages.

Requisition received by the Canadian Intellectual Property Office for Canadian Application No. 3,216,886 dated Feb. 17, 2025, 6 pages.

Requisition received by the Canadian Intellectual Property Office for Canadian Application No. 3,216,886 dated Aug. 20, 2025, 4 pages.

* cited by examiner

CLEANING ASSEMBLY

FIELD

The subject disclosure relates to a cleaning assembly, and particularly to an assembly to engage and disengage a cleaning head from a handle assembly.

BACKGROUND

This section provides background information related to the present disclosure which is not necessarily prior art.

Various items may be cleaned at a selected time. For example, a household appliance may be cleaned with a selected cleaning utensil, such as a brush. The brush, however, generally includes a single structure with bristles or a cleaning pad affixed to a handle. The entire structure is generally a single unit that is used for a selected period of time.

The brush may be used to clean non-sanitary structures. For example, the brush may be used to clean a toilet bowl. During use, the brush may become dirty in a relatively short period of time. The brush, therefore, may be required to be cleaned or selected to be cleaned. Alternatively, the entire brush, including the handle and bristle portion, may be disposed requiring a new brush for additional cleanings.

SUMMARY

This section provides a general summary of the disclosure and is not a comprehensive disclosure of its full scope or all of its features.

Disclosed is a cleaning assembly having a handle and head portion. The head portion may be coupled to the handle portion. The coupling or engagement may include a fitment formed on or with the head portion and a collet assembly provided with a handle portion. The handle and head assembly, therefore, may be moved together for engagement of the head onto the handle assembly.

In various embodiments, a collet includes a structure that allows for a resting or ready state to be maintained without action of a user. In such a state the head may be inserted into the collet and moved relative to the handle assembly to engage the head within the collet. In particular, the head may include a fitment that is engaged by the collet.

Further, in the engaged configuration, the head assembly may move relative to the handle assembly. Movement of the head assembly may include rotation, tilting, and in combinations thereof to assist in positioning the head relative to the handle assembly for use by user.

Disengagement or coupling of the head from the handle assembly is efficient. A user may disengage or unlatch the collet to allow for release of the head. Release of the head may include a forcible ejection of the head from the collet for ease of removal of the head from the collet and removal from the handle assembly.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
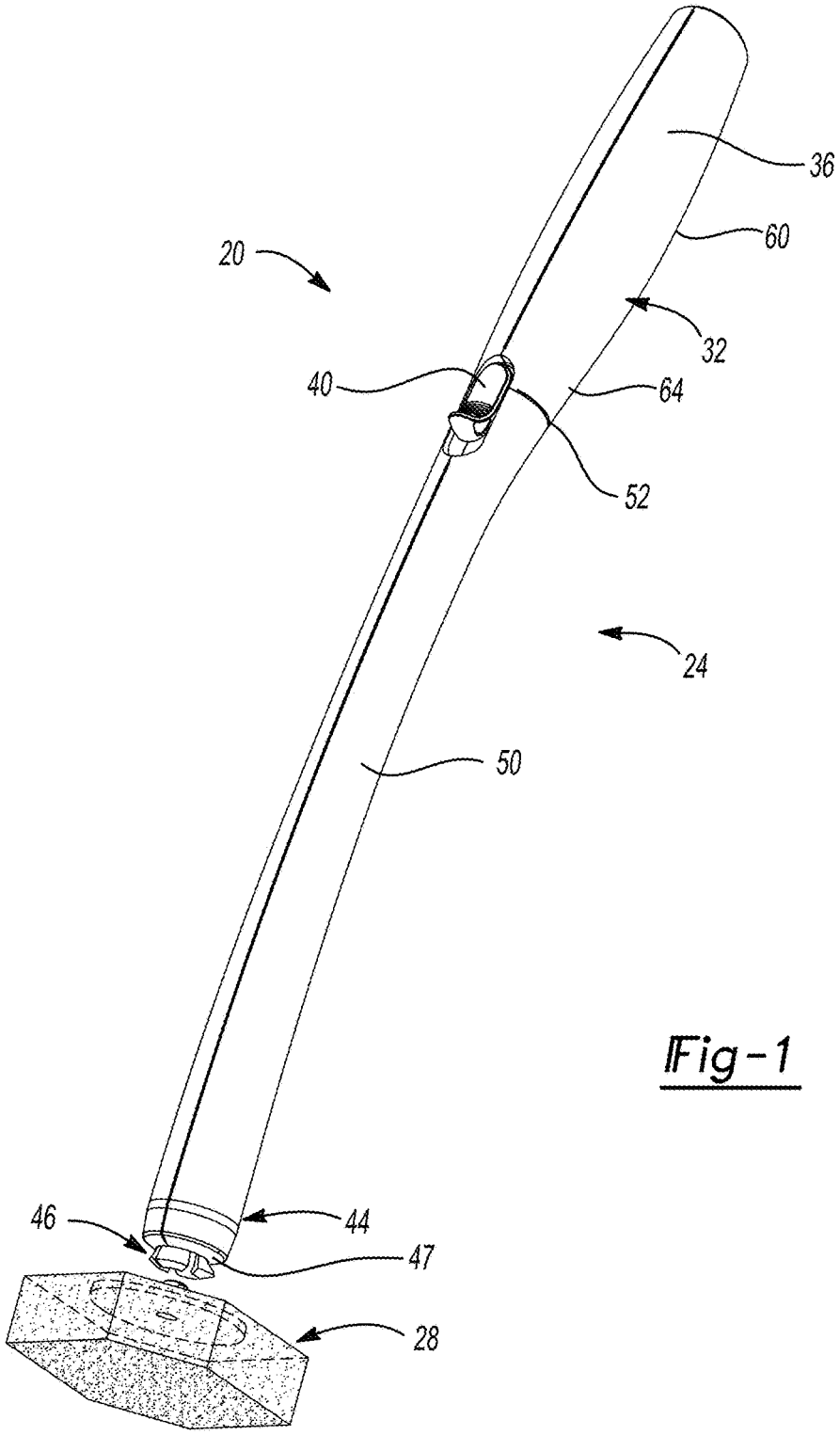
FIG. 1 is a front perspective view of a handle and head cleaning assembly, according to various embodiments.
Figure 2:
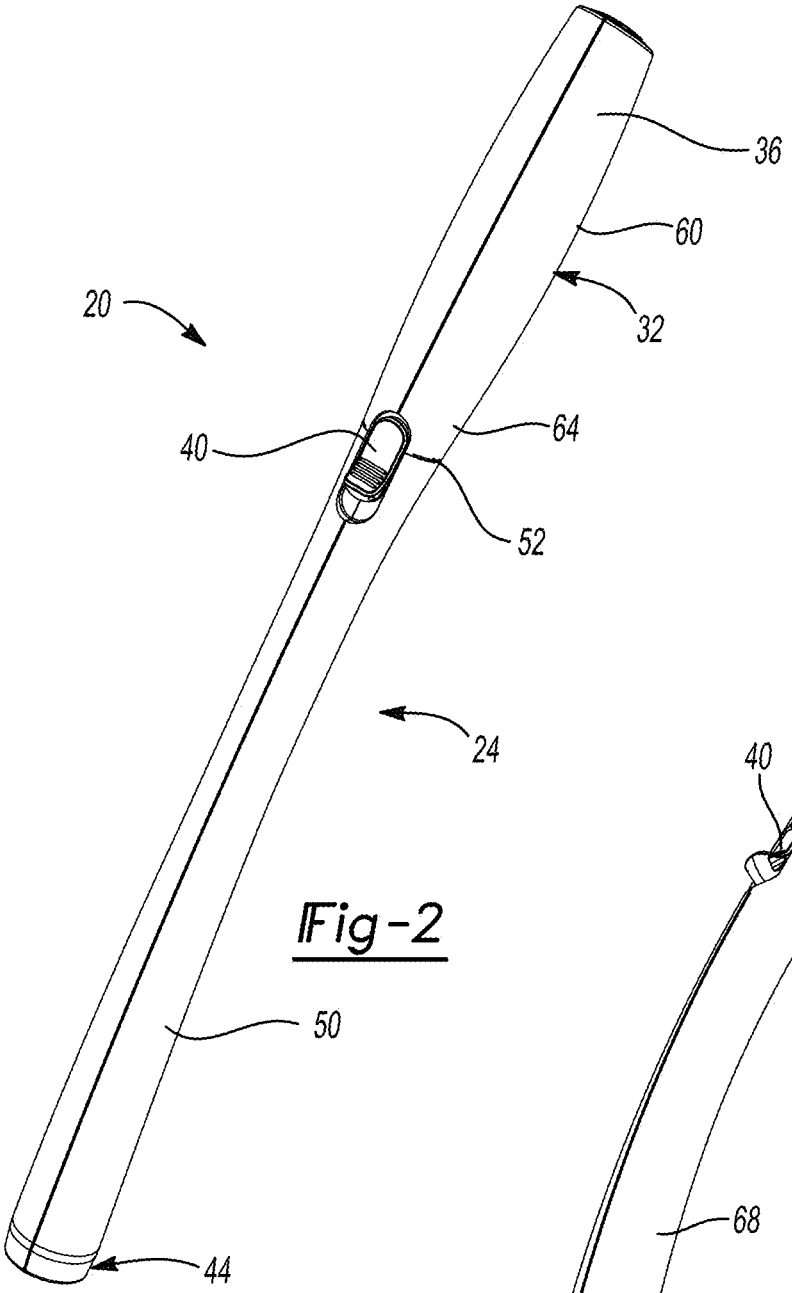
FIG. 2 is a top perspective view of a handle assembly, according to various embodiments.

The following description is merely exemplary in nature and is not intended to limit the present disclosure, application, or uses.

With initial reference to FIGS. 1 through 9, and particularly with reference to FIGS. 1 through 5, a cleaning assembly 20 is illustrated. The cleaning assembly 20 includes a handle assembly 24 and a head assembly 28. The head assembly 28 may be engaged or captured in an engagement or connection mechanism of the handle assembly 24, as discussed further herein, to allow for use of the head 28 for various purposes, such as cleaning a surface. The head assembly may be selectively engaged and disengaged from the handle assembly 24, as discussed further herein.

The handle assembly 24 includes various portions, such as a proximal portion 32, which may include a graspable or enlarged region 36 and a distal portion or region 44. A control button or button 40 may extend to an exterior surface or through an exterior surface at the handle assembly 24 for manipulation by a user.

The handle assembly 24 includes an exterior wall 50 that may extend from the proximal portion 32 to the distal portion 44. In various embodiments, however, the proximal portion 32 may be selectively coupled to the distal portion 44 and at a connection region or portion 52. Thus, the proximal portion 32 may be provided separately from the distal portion 44.

Further the proximal portion may include a selected geometry such as including a bulbous or enlarged portion 60 that tapers to a narrower or smaller region 64, such as near the control 40. The distal portion 44 may also have a change in geometry, such as narrower near or adjacent to the connection portion 52 and expanding to an enlarged region 68, generally nearer a distal or engaging region 46 of the distal portion 44. Further, the handle assembly 24 may include a distal end having a distal surface 47 that may be formed or defined by the handle assembly 24 and may engage in and/or assist in positioning or limiting a movement of the head 28, as discussed further herein.

Generally, the handle assembly 24, therefore, extends along an axis or center line 53 that may be a longitudinal axis and extends through the handle assembly 24. As discussed further herein, however, various portions of the handle assembly and/or the engaging assembly may offer engagement and/or movement of the portions within the handle assembly 24.

With continuing reference to FIGS. 1-5 and particular reference to FIGS. 6-9, the handle assembly 24 may be formed from a plurality of components (e.g., members) that are assembled together at selected times. For example, the proximal portion 32 may be formed of two wall portions, that may or may not be exact halves, 120, 124, as illustrated in FIGS. 7A and 7B. Each of the wall portions may define or form a portion of an exterior of the handle assembly proximal portion 32 and include an internal surface that may define an internal void and/or house various components. Generally, the housing or wall portion 120 may include or define bores 126, 128 that may be formed in the wall portion 120 and/or projections or pillars therein. The second wall portion 124 may include or define projections 134, 136 that may be received in the bores 126, 128 during assembly. For example, the wall portions 120, 124 may be formed separately and assembled during a manufacturing process. The proximal portion 32, however, may be provided as a separate unit from the distal portion 44 that may be assembled by a final user, as discussed further herein. The proximal portion 32 may be capped or closed (e.g., watertight, but not required) with a cap portion or member 140. The cap portion 140 may be formed as a single piece with one or more of the wall portions 120, 124.

The proximal portion 32 may further include a proximal portion engaging feature or portion 144 that may include a projection. The proximal portion engaging feature 144 may include a projection 146 and a recess 148 both defined by the engaging portion 144. The engaging portion 144, therefore, may be received within a selected portion of the distal portion 44, as discussed further therein. The proximal portion, however, may include any appropriate connection portion to connect to the distal portion 44. In addition, the proximal portion 32 may include a recess or a recess wall 150 that allows for movement and/or engagement of the control button 40.

The distal portion 44 may also be formed of two portions, such as two wall portions 160, 162. Each of the exterior wall portions 160, 162 may include exterior surfaces and/or interior surfaces and/or portions. The distal portion 44 may also include various features such as an internal surface 178 of the first portion 160 and an internal surface 180 of the second portion 162. Projections may extend from the inner surface 178 of the first portion 160, such as the projections 166 and 168. The projections may be received in various bores or recesses 174, 176 in the second portion 162. The bores 174, 176 may be formed in various features or projections, such as a projection 290 and a second projection 322 that may interact and/or assist in an engagement of an engagement mechanism 250, as discussed further herein and may also referred to as connection, capture, or holding assembly.

The respective projections and bores 166, 168, 174, 176, however, may allow for assembly of the two portions 160, 162 at a selected time, such as during manufacturing. Accordingly, the distal portion 44 may be provided as a separate unit or portion from the proximal portion 32. The distal portion 44 and the proximal portion 32 may be assembled by the final user. Assembly by the final user may allow or provide for assembly of the proximal portion 32 with the projection 144 to be received in or engage a distal portion connection 190.

The distal portion connection 190 may include various surfaces to engage or receive the projection 144 for assembly of the proximal portion 32 to the distal portion 44. Generally, the proximal portion 32 may be substantially permanently connected to the distal portion 44 once assembled. Therefore, various projections or recesses in the distal portion 44 may engage the projection 146 and/or the recess 148 and the proximal portion 32 to the distal portion 44.

The distal portion 44 at or near the distal region 46 further includes one or more support portions that may be formed as one or more ribs 301 that maybe formed as two rib portions 301*a*, 301*b* in the respective wall portions 160, 162. The ribs 301, as illustrated in FIGS. 6, 8A, 8B, and 9 may be joined together and enclose or at least partially surround the collet 300. Thus, the ribs 301 may support and/or guide the collet 300 during operation of the connection mechanism 250. In addition, the ribs 301 may allow for internal drainage from within the handle 24.

For the present discussion, it is understood that each of the ribs 301 may be similar, thus discussion of the rib formed with the rib portions 301*a* and 301*b* is exemplary. Each of the rib portions 301*a* and 301*b* may define a respective first depression or open indent 303*a*, 303*b*. When the wall portions 160, 164 are joined the rib portions 301*a*, 301*b* may join and/or contact to define a collet passage due to the two first depressions 303*a*, 303*b*. The collet passage may allow passage, movement, and/or guide the collet 300.

Further, each of the rib portions 301*a* and 301*b* may define a respective second depression or open indent 305*a*, 305*b*. When the wall portions 160, 164 are joined the rib portions 301*a*, 301*b* may join and/or contact to define a drain passage due to the two second depressions 305*a*, 305*b*. The drain passage may allow passage or movement of a fluid, such as water or air, out of the handle 24. The collet 300 may form a selected seal with the distal portion 44, but the drain passage may allow for drainage from within the handle 24 at a selected time, such as when the collet 300 does not engage the fitment 96.

Further, as discussed further herein, a connection mechanism 250 allows for connection of the head 28 to the handle assembly 24. As discussed above, the control button 40 may be provided to allow for actuation of various portions of the connection mechanism 250 by the user. The control button 40 may extend through a surface of the handle assembly 24 and will receive and/or allow movement in the recess 150 and a recess 196 of the distal portion 44. The control button 40 may connect to a release latch member 210 that may be assembled within the distal portion 44. The release latch 210 may also be referred to and/or resemble a finger or extended member. The release latch 210 may be guided or positioned by one of our projections, such as a projection 200, and a recess or passage 204 in the distal portion 44. As discussed further herein, therefore, the release latch 210 may be moved by an operator or user moving the control button 40 and may be guided and/or assisted by various projections or portions of the distal portion 44 as discussed further herein.

The release latch 210 allows the user to release the head 28 from the handle assembly 24. Thus, the handle assembly 24 is usable and/or operable to engage the head 28 for various purposes, such as cleaning a selected surface. As discussed herein, the handle assembly may house the engagement mechanism 250 to assist engaging or disengaging the head 28.

Figure 3:
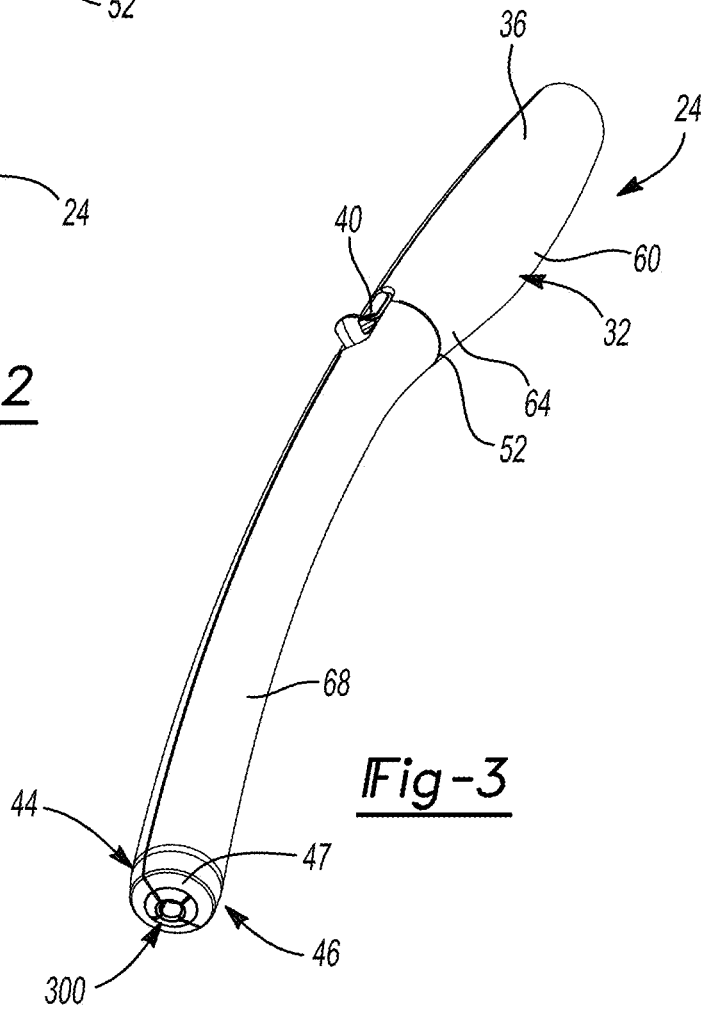
FIG. 3 is a bottom perspective view of a handle assembly according to various embodiments.
Figure 4:
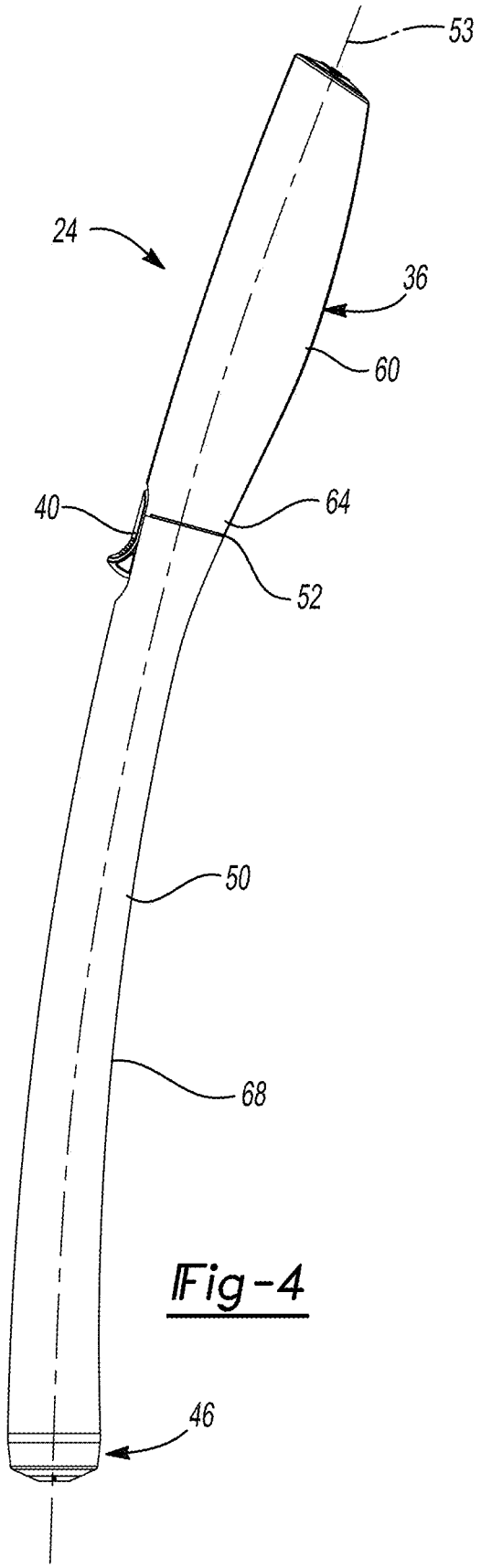
FIG. 4 is a side elevation view of a handle assembly according to various embodiments.
Figure 5:
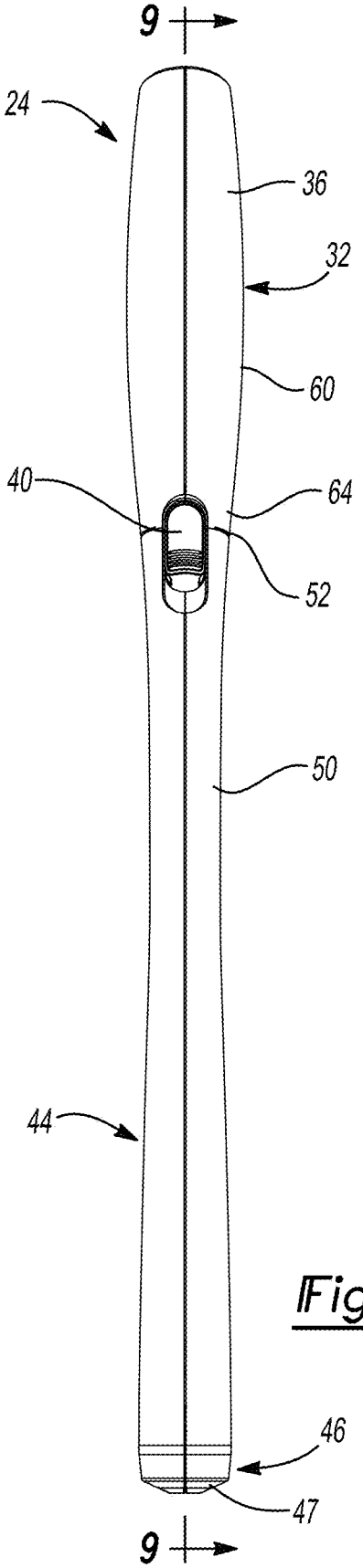
FIG. 5 is a front elevational view of a handle assembly according to various embodiments.
Figure 6:
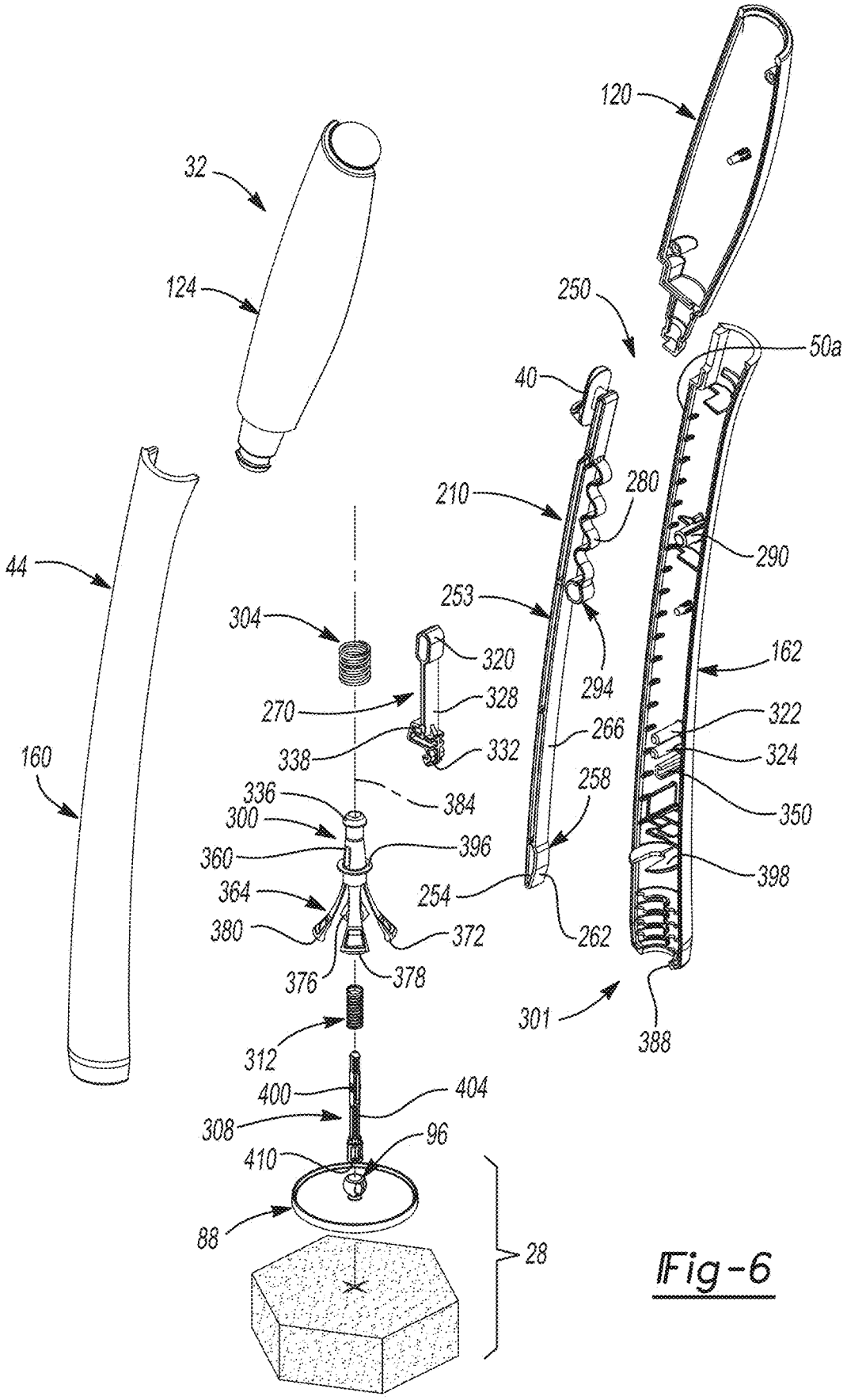
FIG. 6 is an exploded view of a cleaning assembly including a handle and a head assembly, according to various embodiments.
Figure 7A:
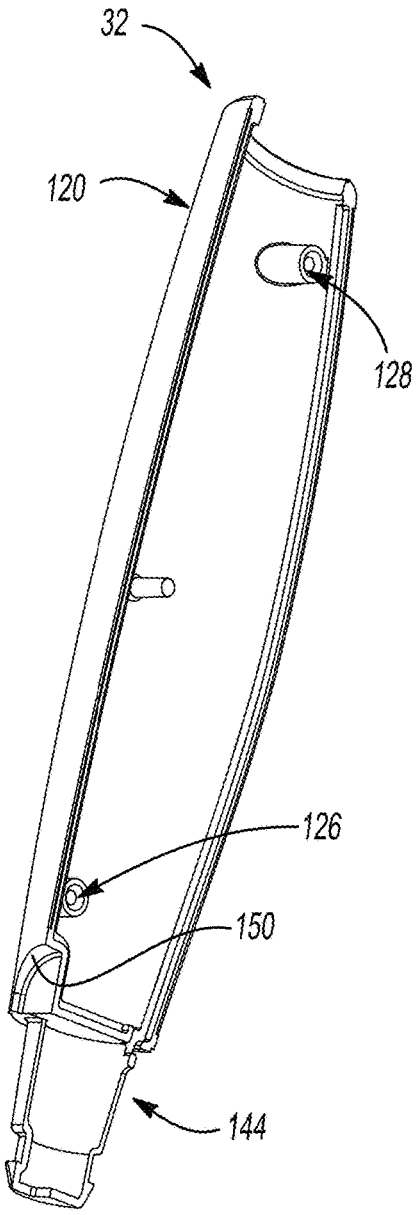
FIG. 7A and FIG. 7B are oppose wall portions of a proximal portion of the handle assembly, according to various embodiments.
Figure 7B:
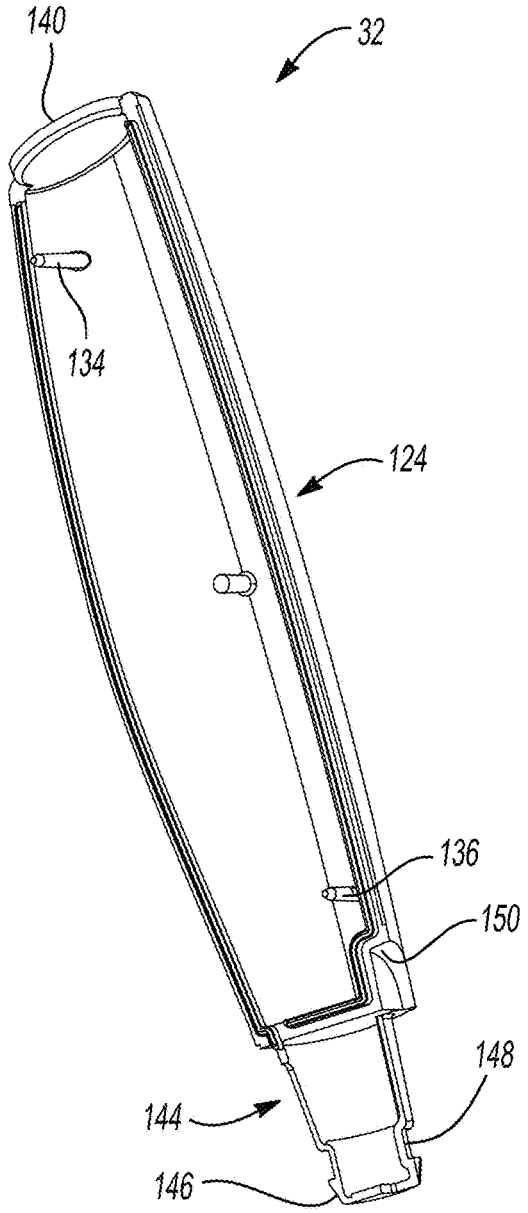
Figure 8A:
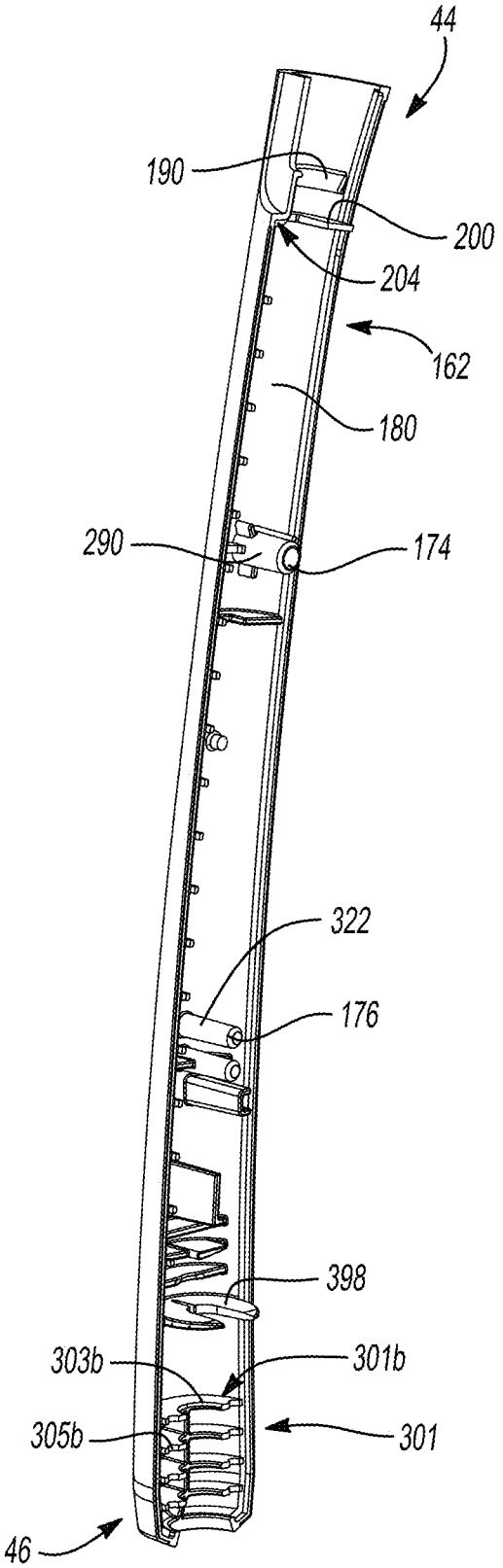
FIG. 8A and FIG. 8B are oppose wall portions of a distal portion of the handle assembly, according to various embodiments.
Figure 8B:
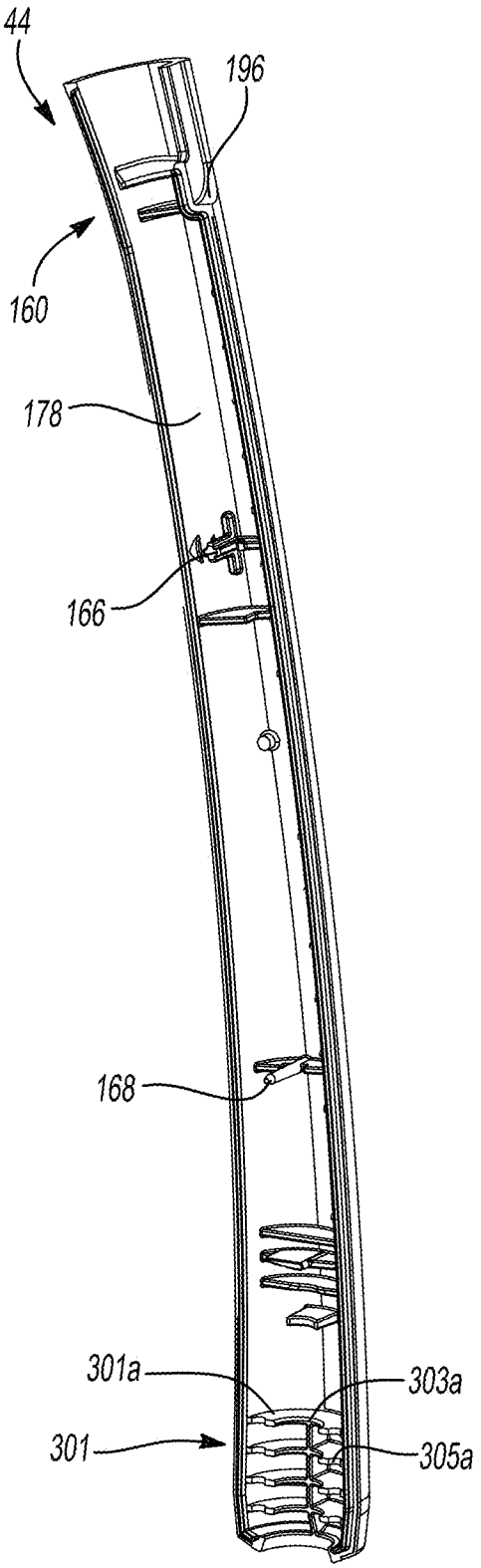
Figure 9:
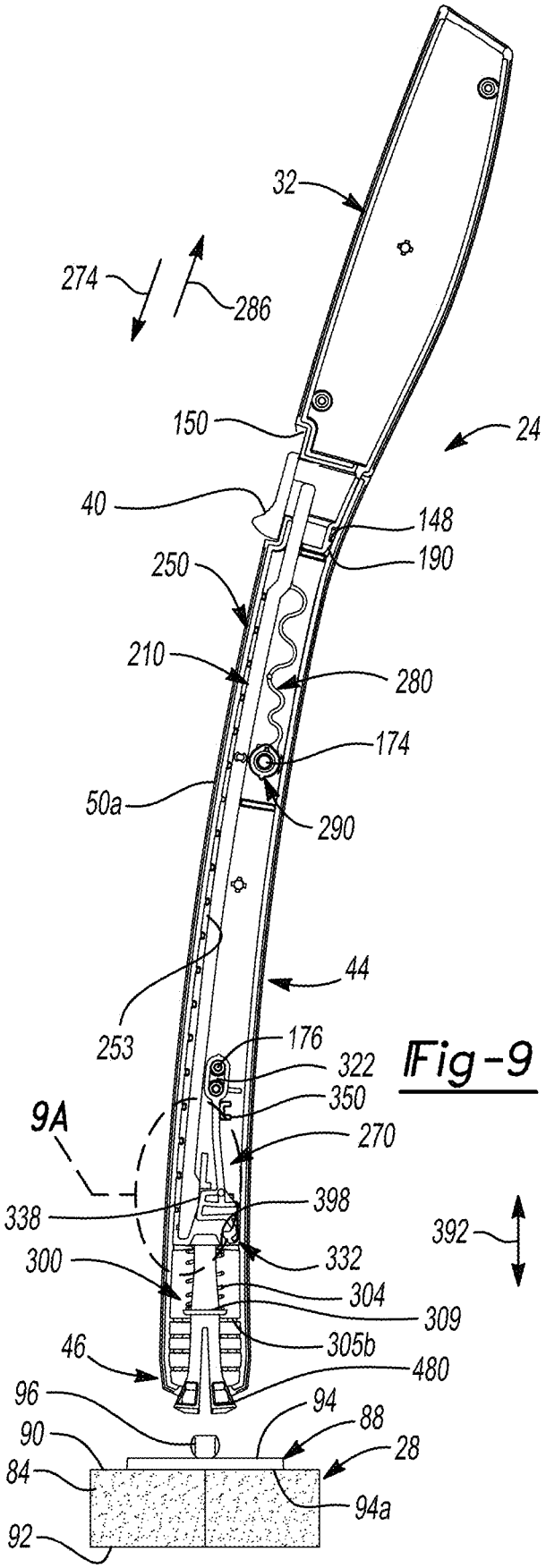
FIG. 9 is a cross-sectional view of the cleaning assembly taken along line 9-9 of FIG. 5.
Figure 9A:
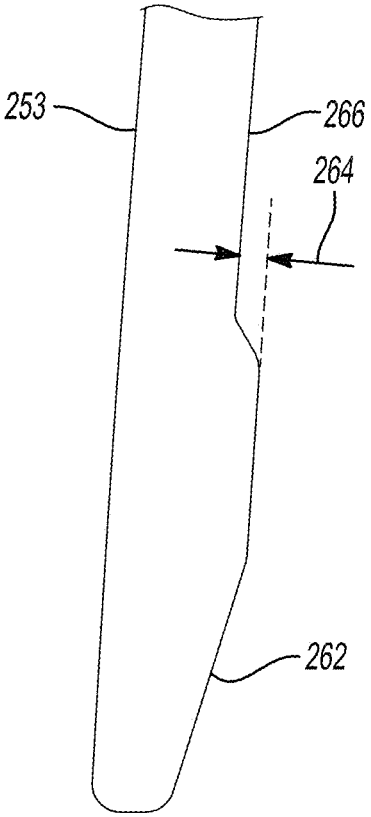
FIG. 9A is a detailed cross-sectional view of a portion of the latch assembly, according to various embodiments.
Figure 10:
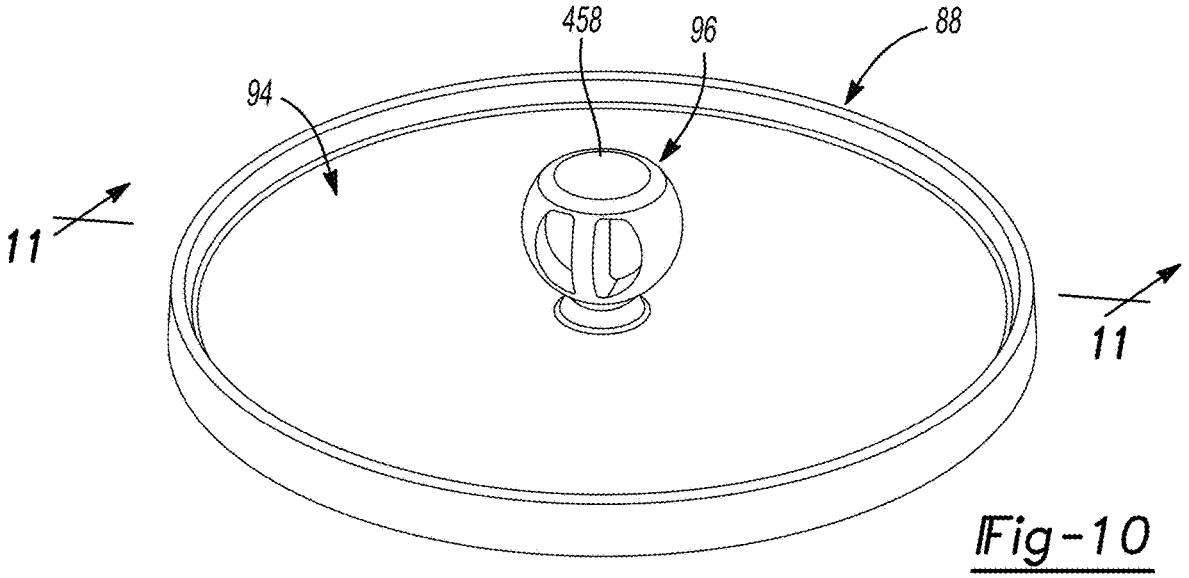
FIG. 10 is a top perspective view of a fitment, according to various embodiments.

With continued reference to FIG. 1 through 9, and particular reference to FIGS. 3, 6, and 9, the handle assembly 24 includes an internal engagement or capture mechanism 250. The engagement mechanism 250 may also be referred to as an actuation assembly or a capture assembly configured to be operated, at least in part, by a user to engage and/or disengage the head 28. The engagement mechanism 250 includes various components to selectively engage the connection member 96 of the head assembly 28. The engagement or connection assembly 250 includes the latch release 210 that includes or is connected to the control button 40. The connection of the control button to the release latch 210 may be formed in any appropriate manner, such as being molded or formed as a single piece therewith. The control button 40 may also and/or alternatively affixed thereto with an appropriate fixation such as an adhesive or welding, or other appropriate connection. In various embodiments, for example, the latch release 210 may be molded as a single piece with the control button 40. The latch release 210 may extend from the control button 40 to a distal end 254. At the distal end a release engagement portion 258 is formed. The release engagement portion 258 may have a selected geometry relative to the elongated portion 253 of the latch release 210. For example, the release portion 258 may extend a distance or have an unlatching surface 262 that extends a selected distance 264 away from a surface 266 of the elongated portion 253. As discussed herein, the latch release 210 may also be referred to as a release latch, release member, release portion, or the like.

The latch release 210 may operably be moved to move the release portion 258 relative to the handle assembly 24, including the distal portion 44. The release portion 258 may engage a release assembly or member 270 in a selected manner, as discussed further herein. The release assembly or member 270 may also be or act as a catch or latch and extend on an arm. Accordingly, the elongated portion 253 of the latch release 210 may be formed of a material and/or include a selected rigidity to allow movement of the release portion 258 when actuated by the control button 40. For example, as illustrated in FIG. 9, the control button 40 may generally be moved in a direction of arrow 274 to have the release portion 258 engage latch member or portion 270. During such operation the elongated portion 253 may be engaged or guided by the distal portion 44, but include a selected rigidity to provide operation or movement to various portions such as, the latch member 270.

The latch release 210 may further contact, including interacting with, a biasing portion 280. The biasing portion 280 may include any appropriate assembly or member, such as a spring, a pliable material, a piston, or the like. In various embodiments, as illustrated in FIGS. 6 and 9, the biasing member 280 may be a spring formed of a selected material having a selected spring constant. In various embodiments, the biasing member 280 may be formed as a single member with the elongated portion 253 and the control button 40. Therefore, the latch release 210 may be formed as a single member and assembled into the handle assembly 24. It is understood, however, that the biasing member 280 may also be formed separate from the elongated portion 253 and thereafter connected thereto. Further the biasing number 280 may be connected to the release portion 210 at any appropriate location and the location illustrated in FIGS. 6 and 9 is merely exemplary.

The biasing member 280 may be formed at a selected angle relative to the elongated portion 253. The selected angle, the geometry of the biasing number 280, and relative installation into the distal portion 44 may allow for a biasing of the control button 40 and the elongated portion 253 generally in the direction of the arrow 286. Thus, the control button 40 may be biased into the recess 150 of the proximal portion 32. In the biased position, the release member 210 is in a substantially non-releasing position such that the capture assembly 250 may engage the connection member 96 as discussed further herein. The biasing member 280 may achieve the biasing position due to engagement or installation of the biasing member 280 onto a selected portion, such as the projection 290 that may define or form the bore 174.

In the assembled configuration, as illustrated in FIG. 9, the biasing member 280 may bias the latch release 210 generally in the direction of arrow 286 due to a spring force of the biasing member 280 and/or bias the elongated portion 253 generally toward a front or anterior wall portion 50*a* of the distal portion 44 due to the geometry and the position of the biasing member 280 relative to the elongated portion 253. Further, the biasing member 280 may include an attachment portion or region 294 that may be fit over the projection 290 to engage the latch release 210 to the distal portion 44. Thus, the latch release 210 may be assembled to the distal portion 44 and operated as discussed above and further herein.

The latch release 210 is operated to release or unlatch a direct fitment connection portion, also referred to as a direct engagement assembly, of the engagement or holding assembly 250. The direct engagement assembly includes the latch arm 270, as discussed above. As discussed further herein the latch arm 270 may be moved or engaged by the latch release 210, such as with the release portion 258. Further the direction of the direct fitment connection portion includes a collet 300 having expandable members to engage the connection member 96, as discussed further herein. The direct engagement portion further includes a collet biasing member 304 that may bias the collet 300 in a selected direction, as discussed further herein. The biasing member 304 may engage and/or be moved with a collet projection 309 that extends from a central portion of the collet 300. The direct engagement assembly includes a plunger member 308 and a plunger biasing member 312, as also discussed further herein. Accordingly, as discussed further herein, the direct engagement assembly may include the collet 300 that engages the connection member 96 and may be latched and unlatched by movement or a selected position of the latch arm or member 270.

With reference to FIGS. 6 and 9, the connection assembly 250 is assembled with the handle assembly 24, with a majority thereof in the distal portion 44 of the handle assembly 24. The distal portion 44, as discussed above, includes various geometry and projections to assist in guiding and positioning the engagement assembly 250. For example, the latch arm 270 includes a wall or projection engagement or capturing portion 320 that includes a passage or more than one passage that may be positioned over a projection 322. The projection 322 may form or define one or more of the bores 176, as discussed above. Further, a plurality of projections, such as the projection 322 and a second projection 324 may be provided to ensure an appropriate engagement of the latch arm 270 within the connection mechanism 250. Extending from the wall engaging portion 320 is an elongated arm 328 that may elastically flex and move within the distal portion 44. The latch arm 270 further include a latch finger or projection 332 that may engage a portion of the collet 300, such as a boss or projection 336 formed an approximal end of the collet 300. The latch arm 270 may further include a latch face or engagement surface 338 that may be engaged and/or moved by the unlatching surface 262 of the unlatch mechanism that includes the release 210.

The elongated arm portion 328 of the latch arm 270 may engage a flexing projection 350 that extends from the internal wall of the distal portion 44. As illustrated in FIG. 9, the elongated arm portion 328 may contact and/or bend or flex due to contact with the flexing projection 350, as discussed further herein. The arm portion 328 may bend when acted upon by the release 210.

The collet 300 includes the projection 336 that extends from a body portion 360. The body portion 360 extends from the projection 336 toward a collar or finger region 364 that includes one or more legs or fingers, for example four fingers 372, 376, 378 and 380. Each of the fingers 372-380 may flex relative to the body 360 as discussed further herein. The fingers 372-380 may be formed in a substantially open manner, such that the fingers 372-380 are positioned at a selected maximum distance from a central axis 384 that extends through the body 360. The fingers 372-380 may move toward the central axis 384 to engage the connection member 96. Movement of the fingers 372-380 may be due to engagement of an exterior surface of each of the fingers 372-380 with a portion of the distal portion 44, such as an interior surface 388. Generally, the distal portion 44 including the engaging region 46 may extend along the axis 384, at least for a selected distance within the distal portion 44. Therefore, the collet 300 may generally move along the axis 384 in the direction of the double-headed arrow 392 due to operations of the engagement mechanism 250, such as the biasing members 304. As discussed further herein, therefore, the fingers 372-380 may move from an open position generally extended away from the central axis 384 toward and/or to an enclosed or engaging position that is generally near the central axis 384. Operation of the collet 300 to engage the connection member 96 is also discussed further herein.

The collet biasing member 304 may be provided as a selected member, such as a coil spring having a spring constant, a biasing member or material having a selected spring constant, or the like. Generally, the biasing member 304 may be positioned around the body 360 and engages a projection or surface 396 of the collet 300 and an internal projection or ring 398 of the distal portion 44. Therefore, movement of the collet 300 may be due to the biasing or spring force of the biasing member 304 and/or to oppose or overcome the force provided by the biasing member 304.

The engagement assembly 250 further includes the plunger 308. The plunger 308 may be movably captured or positioned within the collet 300. For example, the plunger 308 may include a proximal projection 400 and a distal recess 404. The plunger 308, for example, may be captured within a recess within the collet 300 allowing a movement of the plunger 308 relative thereto due to the recess 404. Further, the plunger biasing member 312 may bias the plunger 308 generally toward the distal region 46 and/or the distal end 47 of the distal portion 44. Engagement by a fitment 88 of the head assembly 28 may cause movement of the plunger 308 generally along the axis 384, such as against the biasing member 312 and into the collet 300. The plunger 308 further includes a distal end or surface 410 that is substantially flat or includes a selected geometry to engage the connection member 96. As discussed further herein, the distal surface 410 may allow for alignments and centering of the connection member 96 and the respective head assembly 28.

The plunger biasing member 312 may also be formed as a selected biasing portion. In various embodiments, for example, the biasing member 312 may be a coil spring with a selected spring force. In various embodiments, however, the biasing member 312 may be a biasing member with a selected spring force that may bias the plunger 308 in a selected position, as discussed further herein.

As discussed above, the handle assembly 24 may be provided with the connection mechanism 250 to connect to the head assembly 28. The head assembly 28 includes the connection portion or fitment 88 and a substrate 84. The substrate 84 may be a selected material, such as a flexible or compliant material including a pad or a sponge. In various embodiments the substrate 84 may include a cleaning material that is selectively released. The substrate 84 may be a selected shape and geometry, for example, including a first or proximal surface 90 and a second or distal surface 92.

The fitment 88 may be provided in a selected geometry to be captured or engaged by the engagement system 250, including within the collet 300. The fitment 88 may have various portions, such as the connection member 96 that extends from a collar or plate 94 (also referred to as a base). The purpose of the plate 94 is to aid in the distribution of force to the substrate 84. The base 94 may have a variety of shapes, including but not limited to: a circle, wheel, star, polygon, coil, fingers or legs extending out from the connection member 96, and any other suitable shape. Depending on the shape of the base, the base may be flat, curved or angled to enable the distribution of force to the substrate 84.

The plate 94, in various embodiments, includes a surface **94*a* that may be connected to the proximal surface 90 of the substrate 84. In various embodiments, the fitment 88, such as the plate 94 may be partially or entirely surrounded by the substrate 84. Thus, at least a portion of the fitment may extend through the substrate such that the fitment 88 extends from both the surfaces 90 and 92. Also, the substrate 84 may be provided in more than one piece and connected to the fitment 88**.

The connection member 96 may be connected to the plate 94, such as formed as a single piece therewith. In various embodiments, however, the connection member 96 may be attached to the plate 94 with appropriate connection systems or portions, such as a connection member, snap fit, friction fit, threaded connection, an adhesive, or the like. Nevertheless, in various embodiments, the connection member 96 may be formed as a single piece with the plate 94 such that the fitment 88 is formed as a single piece (e.g., via injection molding).

The connection member 96 includes a selected geometry, such as an outer surface 450 that may be engaged by an internal surface or selected surface 454 formed by one more of the fingers 372-380. Generally, the fingers 372-380 may form or have collar portions that define the surfaces 454 and move to engage and disengage the connection member 96. It is understood that any appropriate number of the fingers may be provided and four is merely exemplary and each may define a portion of the collar and the respective portion of the surface 454.

The exterior surface 450 of the connection member 96 may be any appropriate surface, such as a curved surface that may have a constant and/or varying radius. In addition, and/or alternatively, the exterior surface 450 may be a cylindrical surface, faceted surface, or include a mushroom or t-shape cross section as illustrated in phantom 450' in FIG. 11. Nevertheless, the exterior surface 450 may be formed to engage in a selected manner, such as to allow selected movement (e.g., swiveling or pivoting) and/or may limit other movement (e.g., translation) of the head assembly 28 relative to the collet 300. It is understood, however, that the exterior surface 450 may be an appropriate shape, such as a partial curve or a partial spherical surface, to allow for movement of the head assembly 28 relative to the collet 300, as discussed further therein. It is understood that the exterior surface 450 may also define a substantial portion of a sphere, such as about 70% or more of a spherical surface.

Figure 11:
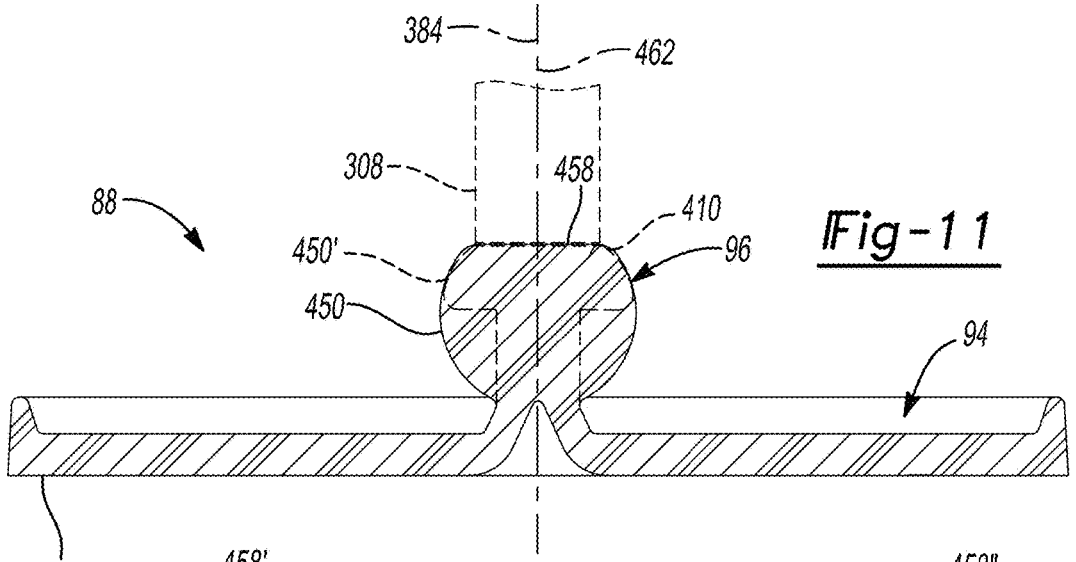
FIG. 11 is a cross-sectional view of the fitment of FIG. 10, taken along lines of 11-11.
Figure 15:
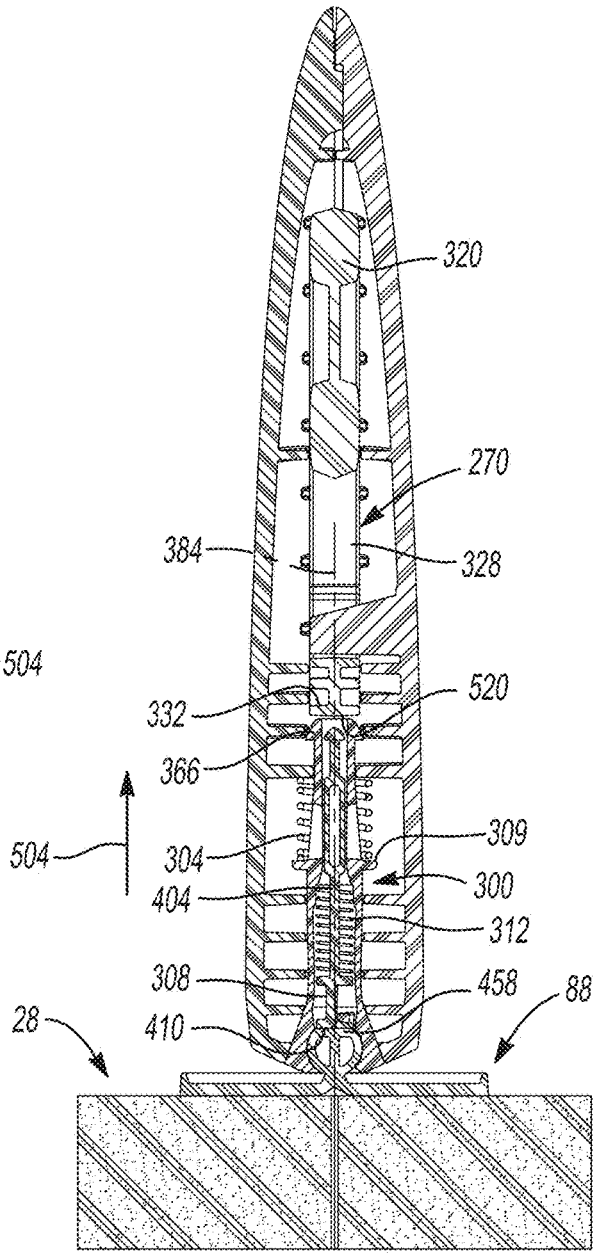
FIG. 15 is a detailed cross-sectional view taken along line 15-15 of FIG. 14.

In various embodiments the connection member 96 further includes a proximal or upper surface 458. The proximal surface 458 may be substantially flat, in various embodiments, as illustrated in FIG. 11. The proximal surface 458 may engage the distal surface 410 of the plunger 308. The distal surface 410 may be substantially flat or planar. The proximal surface 458, for example as illustrated in FIGS. 11 and 15, may engage the distal plunger surface 410 to allow for contact of the plunger 308 with the proximal surface 458 to selectively hold and/or recenter the head 28 relative to the long central axis 384 of the collet 300. By providing the distal surface 410 to engage the proximal surface 458 of the connection member 96, the plunger 308 may assist in holding the connection member 96 in a selected orientation. The selected orientation may be aligned with the collet 300 and/or the long central axis 384. The connection member 96 may also have a central connection member axis 462 that is aligned with the long central axis 384 or the collet 300 when the plunger surface 410 is selectively fully seated with the proximal surface 458 or when the head assembly 28 is selectively aligned with the central axis 384.

Generally, the plunger biasing member 312 applies a force on the plunger 308 that is transferred to the plunger surface 410 and to the proximal surface 458. This force assists in aligning and/or returning the head 28 to the aligned positioned such that the central axis 384 is aligned with the connection member axis 462 when the plunger force is not overcome, such as by use of a user. As discussed herein, however, the connection member 96 may move relative to the collet 300, such as the finger portion 364, to allow for angling or movement of the connection member axis 462 relative to the central axis 384.

Figure 11A:
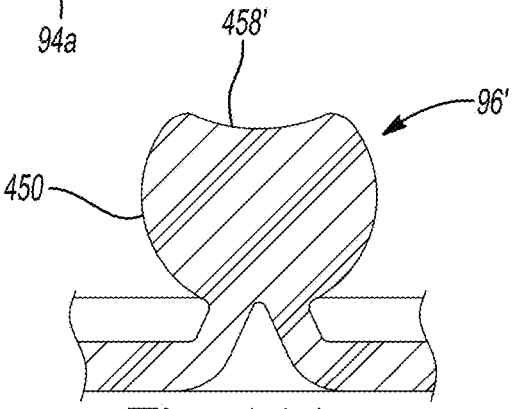
FIG. 11A is a cross-sectional view of a fitment, according to various embodiments.
Figure 11B:
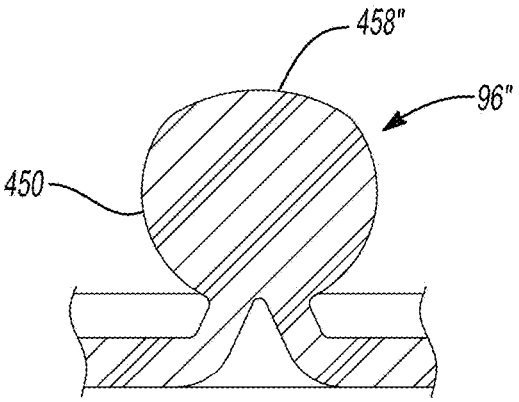
FIG. 11B is a cross-sectional view of a fitment, according to various embodiments 1.

The connection member 96 may also and/or alternatively, in various embodiments, be provided with a non-planar proximal surface. For example, as illustrated in FIG. 11A a proximal surface 458' may be concave. As a further example, as illustrated in FIG. 11B the proximal surface 458" may be convex. The proximal surface 458, 458', 458" regardless of specific shape may be contacted by the distal surface 410 of the plunger 308 to assist in recentering the fitment 88 and/or the head assembly 28. In various embodiments, at least an amount of contact, such as two points of contact, between the plunger 308 and the fitment 88, including the proximal surface 458, 458', 458" allow for the recentering to occur substantially automatically.

Figure 12:
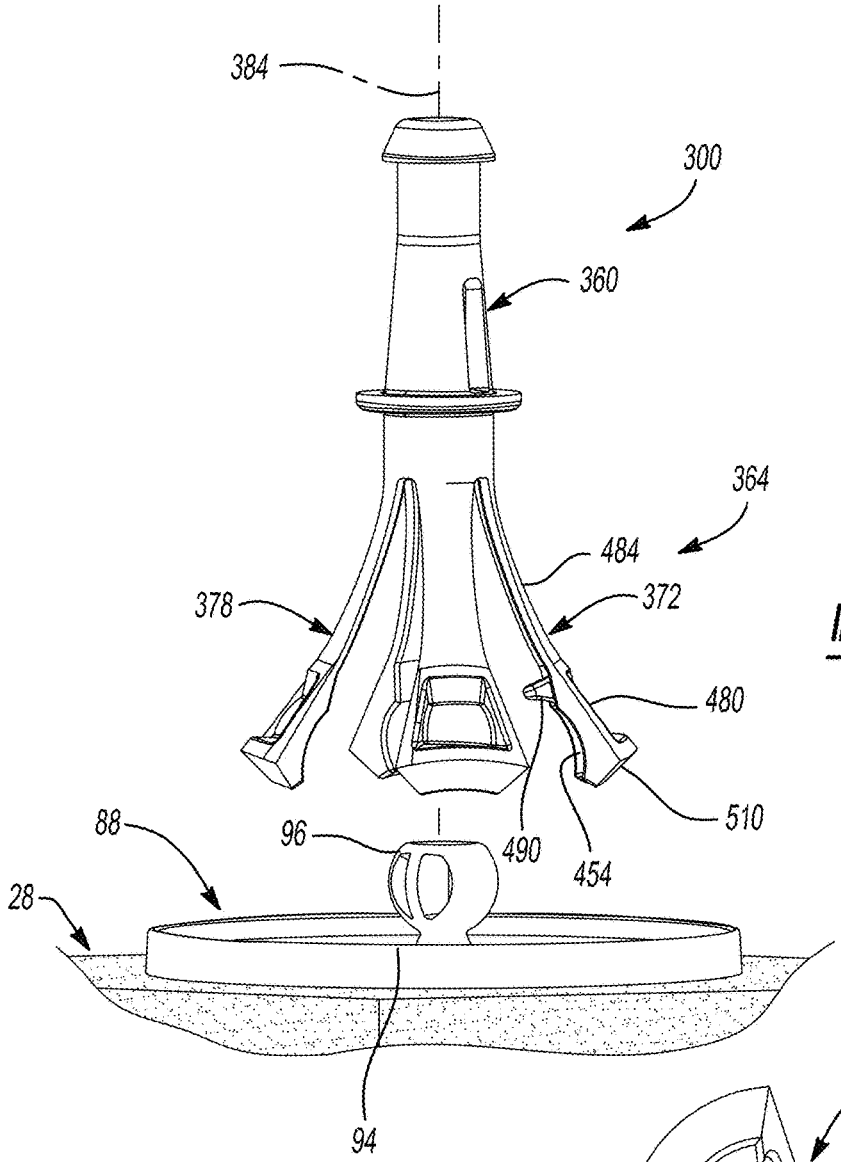
FIG. 12 is a detailed view of a collet and fitment, according to various embodiments.
Figure 12A:
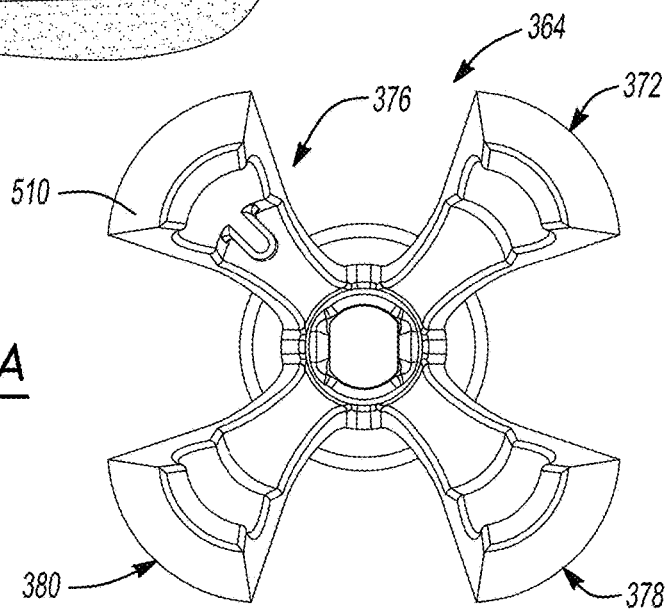
FIG. 12A is a detailed end view of a collet, according to various embodiments.

With reference to FIG. 6, FIG. 9, and FIG. 12 the collet 300 will be described in greater detail. The collet 300 may be formed such that to the fingers 372-380 are biased or spread away from the central axis 384, as illustrated in FIG. 12. As discussed further herein, however, the fingers 372-380 may engage the internal surface 388 of the distal end to move of compress fingers 372-380 together toward the central axis 384. Each of the fingers, for example the finger 372, may include an exterior compressing or moving surface 480. The exterior surface 480 may be configured, such as extending along a selected angle relative to the central axis 384 to urge or move the collet fingers 372-380 towards the central axis 384 when engaging the internal surface 388 of the distal portion 44. Each of the fingers 372-380 includes a respective elongated portion or member 484 that may elastically flex to move relative to the long central axis 384. Further, each of the fingers 372-380 include the internal surface 454 that may be formed to cooperate with the connection member 96 to allow a selected movement of the connection member 96 relative to the collet 300, particularly when the collet 300 is in the engaged position. Further, the collet 300 may include one or more travel stops 490, also referred to as a spur, to limit an inward travel of the connection member 96 into the collet 300 and/or into the distal portion 44 when the head 28 is assembled to the collet 300. To assist in operation of the handle assembly 24, the plunger 308 may include a groove formed in its exterior and generally running along the direction of axis 384 that allows the plunger 308 to translate around the spur 490.

Figure 13:
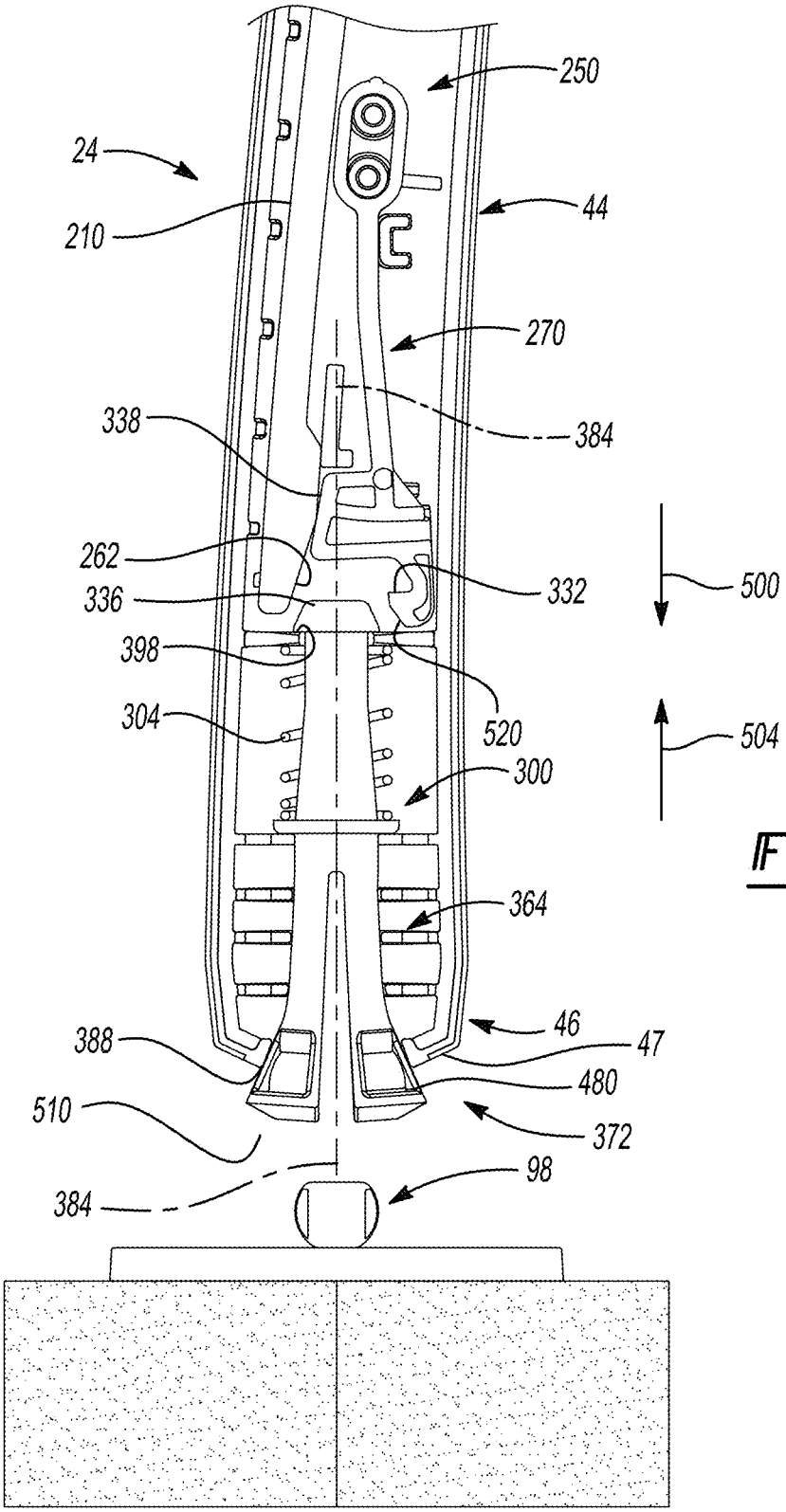
FIG. 13 is a detailed cross-sectional view of the cleaning assembly in an unengaged configuration and unlatching position, according to various embodiments.

With reference to FIGS. 9 and 13 the connection assembly 250 is illustrated in a disengaging or disconnecting state. In particular, the collet 300 is moved or positioned near the engaging region 46 of the distal portion 44 and the collet fingers 372-380 are separated from the central axis 384 and the exterior surfaces 480 are moved away from and/or disengaged from the internal surface 388 of the distal portion 44. Further, the unlatching system 210 is moved such that the unlatching surface or movement surface 262 is engaged or moved to contact and/or in various embodiments move along (e.g., translate towards the distal end 46) the surface 338 of the latch member 270. In various embodiments, the surface 262 is always in contact with surface 338 and translating the unlatching system 210 causes the ramped contact surface 262 to drive surface 338 sideways, translating the latch surface or portion 332 of the latch 270 away from the center axis 384 and the projection 336. Thus, the catch finger 332 is moved to disengage the projection 336 of the collet 300.

As the latch surface 332 is disengaged from the projection 336 the biasing member 304 has biased the collet 300 toward the distal region 46 and/or distal surface 47 in generally the direction of arrow 500. Accordingly, the fitment 88 is generally not engaged or will not be engaged within the collet 300. Also, as discussed above, the release latch mechanism 210 may be biased toward the proximal portion 32 when not acted upon by a user. Accordingly, as illustrated in FIG. 13, the latch assembly or release latch assembly 210 is shown in the unlatching position but may be biased or retracted from the unlatching position when a user is not engaging the control button 40. In a resting configuration, when the unlatching member 210 is not engaging the latch 270 the catch finger 332 of the latch 270 may move generally towards the axis 384 of the collet 300. However, as the collet 300 is biased toward the distal region 46 generally in direction of arrow 500 the catch finger 332 will not engage the projection 336 of the collet. Therefore, in a ready or rest position or configuration the collet 300 may be in the open or unengaged position generally biased in the direction of arrow 500 due to the biasing member 304.

Figure 14:
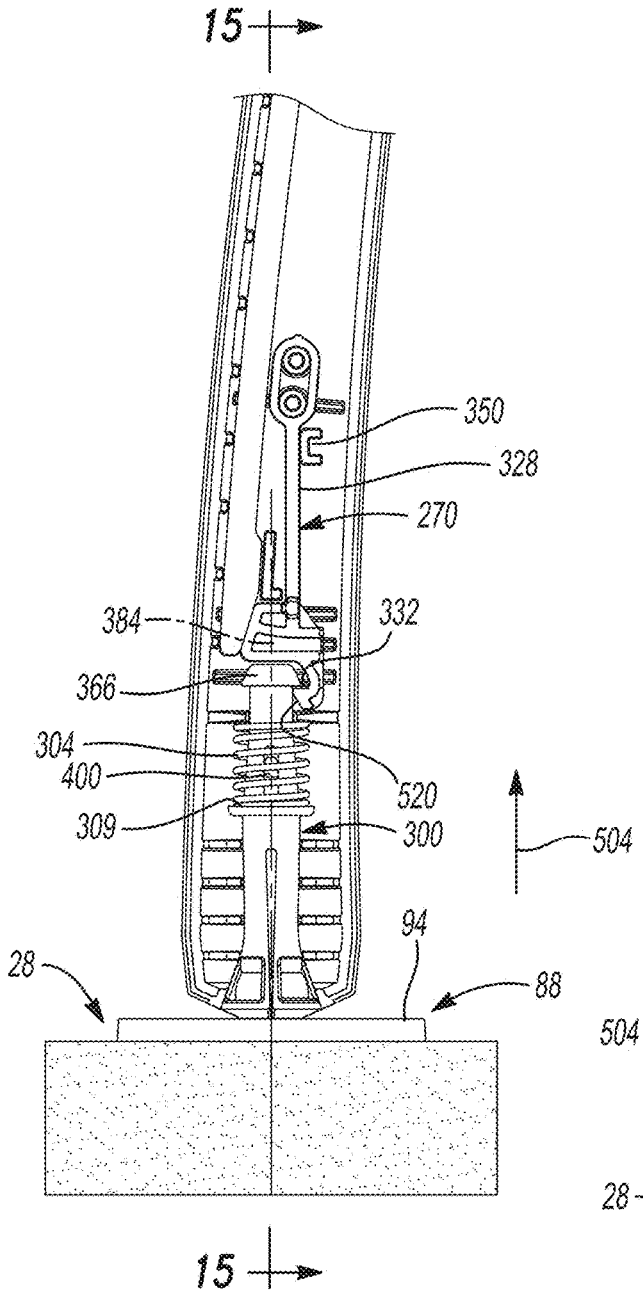
FIG. 14 is a cross-sectional view of the cleaning assembly in an engaged configuration.

To engage the connection member 96 into the collet 300, the user or any appropriate mechanism may move the connection member 96 toward the collet 300 (when in the open/unlatched configuration) and/or the collet 300 may move toward the connection member 96. For example, user may grasp the head 28 and press the connection member 96 into the collet 300 and also press the handle assembly 24 toward the connection member 96. The connection member 96, therefore, may be moved into or toward the engaging surface or travel stops 490 of the collet assembly 300. The connection member 96 may first engage the plunger surface 410 and move the plunger 308 generally in the direction of arrow 504 generally along the axis 384. The plunger 308 may move by overcoming the force of the biasing member 312 and allow the connection member 96 to move toward the collet finger portion 364. Turning reference to FIGS. 14 and 15, the plate 94 may engage distal ends 510 of the collet fingers 372-380 and generally move the fingers 372-380 and the collet 300 in the direction of arrow 504 after overcoming the biasing force of the biasing spring 312 to move the plunger 308.

Once engaging the distal end 510 of the fingers 372-380 the collet 300 may also move generally in the direction of arrow 504. By moving the collet 300 generally in the direction of arrow 504, the collet 300 may overcome the biasing force of the biasing member 304 and move the projection 366 generally along the axis 384. The projection 366 may generally move and engage the outer catch surface 520 of the catch or latch 270 to bias or move the catch 270 as the projection 366 moves past. At a certain position, the projection 336 will move past the point of projection of the catch finger 332 and the elongated portion will bias the catch finger 332 toward the central axis 384 of the collet 384 such that the catch finger 332 will catch projection 336 and hold the collet 300 in a selected and engaged position, as illustrated in FIG. 14. The elongated arm portion 328 of the latch 270 may engage or be held by the projection 350 to act as a spring for movement or biasing of the catch finger 332 relative to the central axis 384.

With reference to FIGS. 1-15 and further reference to FIGS. 16, 17, and 18 operation of the handle assembly 24 to engage and disengage the head assembly 28 as briefly discussed above, will be described and illustrated in greater detail. With initial reference to FIG. 16, the handle assembly 24 may be provided and generally included in a relaxed or ready state when the head 28 is not engaged into the collet 300 of the engagement assembly 250. The latch 270 is in a latched configuration such that the catch finger surface 332 is at or near the projection 336 of the collet 300, but not engaging the collet 300. The elongated arm 328 may bias or hold the catch finger 332 in the latched or relaxed position and ready to engage the collet projection 336 when operated to do so. Further, the latch release 210 is biased generally toward the proximal portion 32 with the biasing portion 280 such that the unlatching surface 262 is only initially engaging or not in an activated position engaging the surface 338 of the latch 270. The collet 300 is biased with the biasing member 304 in the unengaged or ready position where the distal end portion or distal tips 510 of the collet 300 extend beyond the distal region 46 of the distal portion 44. In particular, the collet distal ends 510 extend beyond the distal surface 47 of the handle assembly 24. Further, the plunger 308 is also biased toward the distal region 46 by the biasing member 312.

Figure 16:
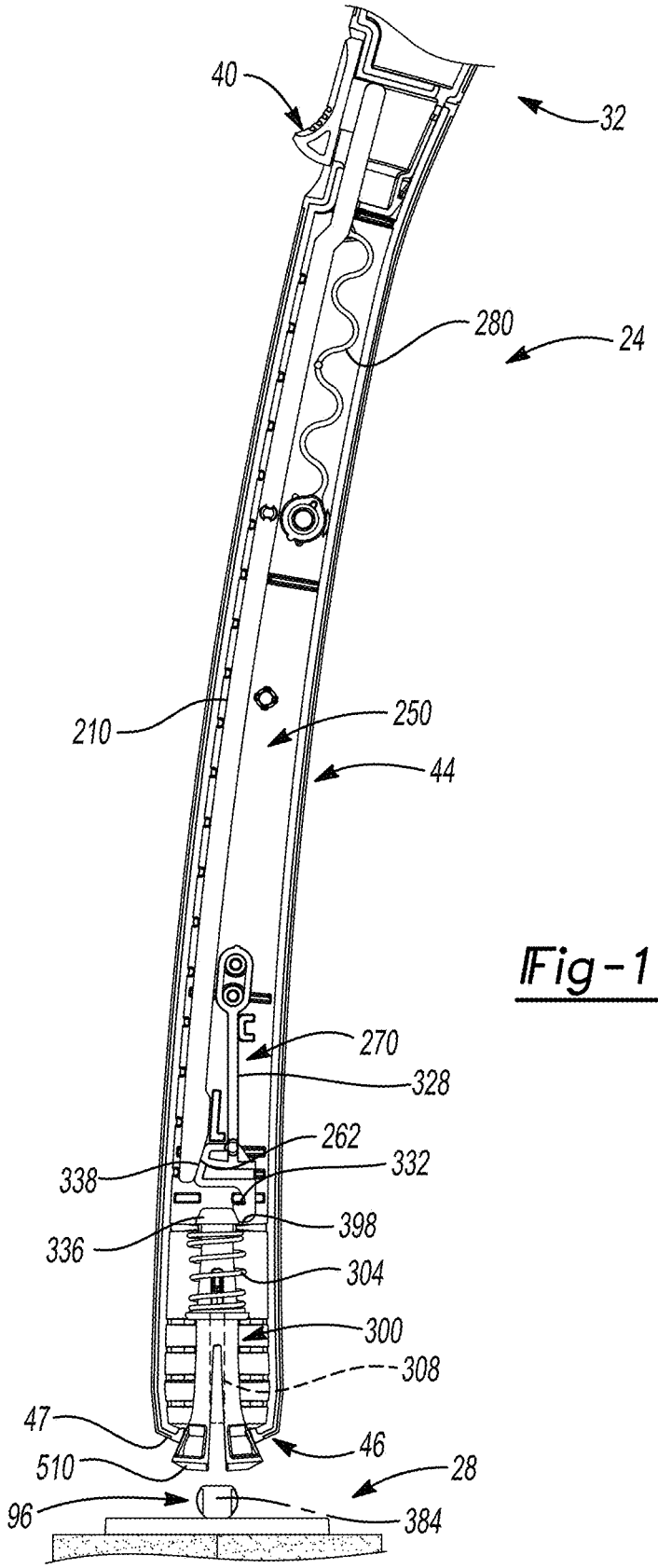
FIGS. 16, 17, and 18 show in series the cleaning assembly in a ready or unengaged configuration, engaged configuration, and releasing or unlatching configuration.

Accordingly, as illustrated in FIG. 16, in the relaxed or unengaged configuration of the engagement assembly 250 the collet 300 is extended at least partially from the distal region 46 and/or distal surface 47 of the handle assembly 24. Further, the collet fingers 372-380 extend a selected distance away from the central axis 384 of the collet 300. In this configuration, the collet fingers 372-380 are configured to receive the connection member 96 and engage the connection member 96, as discussed further herein and above. The handle assembly 24 in the relaxed or ready configuration and does not require manipulation by the user to adjust or reconfigure the engagement mechanism 250 to receive or engage the connection member 96. Rather, once the head assembly 28 is released from the handle assembly 24, as discussed further herein, the engagement assembly 250 remains in the ready configuration to receive or engage a new or additional head assembly by engaging the connection member 96.

Figure 17:
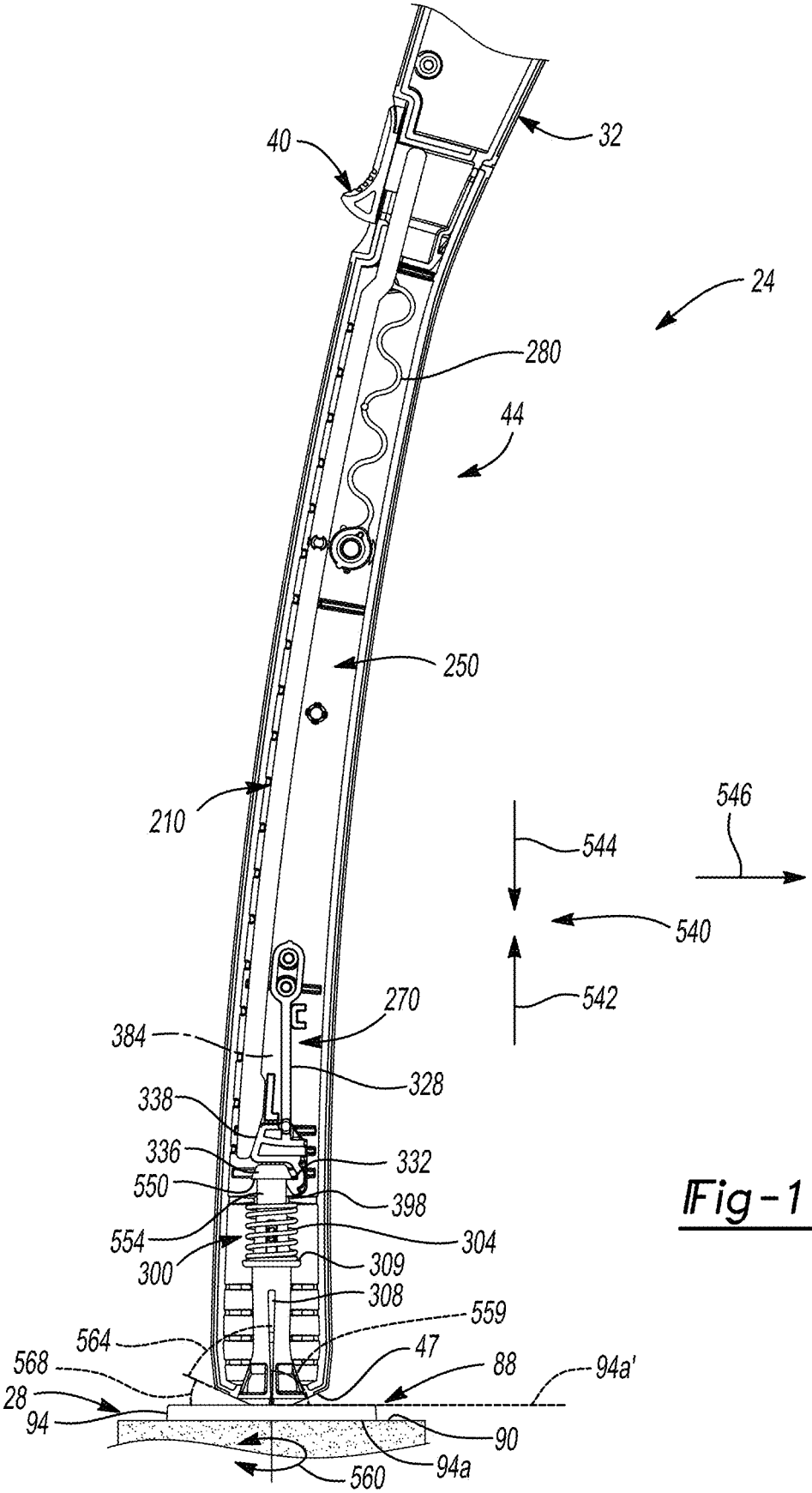

Turning reference to FIG. 17, as the collet 300 is moved in the direction of arrow 542 the collet projection 336 may move the latch 270 by sliding against surface 520 and moving the catch finger surface 332 of the latch 270 in a lateral direction, such generally in the direction of arrow 546. The movement may be lateral or is generally perpendicular to the long central axis 384. As the collet continues to move in the direction of arrow 542, the projection 336 may move past the catch finger surface 332 and a collet latch surface 550 may be engaged or catch with the latch finger surface 332 of the latch 270. The elongated arm portion or arm portion 328 of the latch 270 may elastically deflect to allow movement of the projection 336 past the latch finger surface 332 and relaxing or moving of the latch finger surface 332 to engage the collet latch surface 550 once the latch is past the projection 336 and in the latch recess area 554. Further in this latched configuration, the biasing member 304 may be compressed and under tension, but the collet 300 is held due to the latch finger surface 332 of the latch 270. The biasing member 304 may be compressed between the projection 398 and the collet projection 309. Also, as discussed above, the release member 210 is in the unreleased or unengaged position generally biased in the direction of arrow 542 toward the proximal portion 32 by the biasing member 280.

Further, as discussed above and illustrated in FIG. 11, the plunger 308 may engage the connection member 96 when in the engaged configuration, as illustrated in FIG. 17. The plunger 308 includes the distal surface 410 that may directly engage (i.e., contact) the proximal surface 458 of the connection member 96. The respective distal surface 410 and/or the proximal surface 458 are generally formed and provided such that when a lack of force is applied to the head assembly 28, the interaction of the distal surface 410 of the plunger 308 and the proximal surface 458 of the connection member 96 move the head assembly 28 to a substantially perpendicular configuration (e.g., neutral) as illustrated in FIG. 17. As discussed above, the biasing member 312 may provide a force to the plunger 308 to assist in providing a force to move the head assembly 28 to the neutral or perpendicular configuration. In the neutral configuration the head assembly 28 is not angled relative to the central axis 384. In various embodiments, for example, in the neutral configuration a line **94*a*' that is generally co-linear or co-planar with the surface 94*a* of the fitment 88 is generally perpendicular (e.g., 90 degrees (°)+/−10°) to the axis 384**.

In various embodiments, both the distal surface 410 and/or the proximal surface 458 are generally formed flat or planar. In various embodiments, the proximal surface 458 has sufficient contact with plunger distal surface 410 so that the head assembly 28 will return to the neutral configuration (e.g., recenter) automatically after tilting. The proximal surface 458 may be slightly concave or convex and still allow for recentering. The proximal surface 458 may generally have contact with distal surface 410 for recentering and/or maintaining center. In various embodiments, when the head assembly 28 is tilted (as illustrated in phantom in FIG. 15), there may be only a single point of contact between the plunger bottom surface 410 and the fitment top surface 458.

As discussed above, the head assembly 28 may move relative to the handle assembly 24, even when in the engaged configuration as illustrated in FIG. 17. While the distal surface 410 of the plunger 308 and the proximal surface 458 of the engagement member 96 may allow for the head assembly 28 to be substantially perpendicular, such as including angle 559 that is about 90 degrees relative to the axis 384 when no force is applied to the head assembly 28. The head assembly 28 including the fitment 88, however, may be movably held by the collet 300. For example, the head assembly 28 may rotate around the axis 384 either in the perpendicular configuration and/or an angle configuration, as discussed herein. The head assembly 28 may generally rotate in the direction of the double-headed arrow 560 such as completely around the axis 384, including more than one rotation in a single direction. It is understood, however, that the head assembly 28 may be limited in its rotation such that it may rotate only a portion of a 360-degree rotation, such as including at least about 180 degrees around the central axis 384.

Further, the head assembly 28 may tilt relative to the collet 300 and/or the distal end surface 47 of the distal portion 44 of the handle assembly 24. The distal end surface 47 may extend at an internal angle 564 relative to the central axis 384 of less than 90 degrees, such as about 50 degrees to about 89 degrees, further including about 50 degrees to about 70 degrees, and further include about 50 degrees to about 65 degrees and/or including at least about 70 degrees. The head assembly 28 may tilt toward (or away from) the distal end surface 47 to achieve a selected angle 568. The angle 568 may be a complementary angle relative to the angle 564. The angle 568 may be about 1 degree to about 50 degrees, including about 5 degrees to about 40 degrees, and further including about 10 degrees to about 30 degrees, and including up to 25 degrees.

The distal surface 47 may limit the amount of tilting and/or rotation of the head assembly 28 when captured within the collet 300. Nevertheless, the distal surface 47 that defines the angle 564 that may be less than 90 degrees as discussed above. Therefore, even in the engaged or coupled configuration to the fitment 88 the head assembly 28 may move relative to the handle assembly 24 such as when a force is applied by a user, such as the user engaging a cleaning surface with the head assembly 28 by grasping the handle assembly 24.

Figure 18:
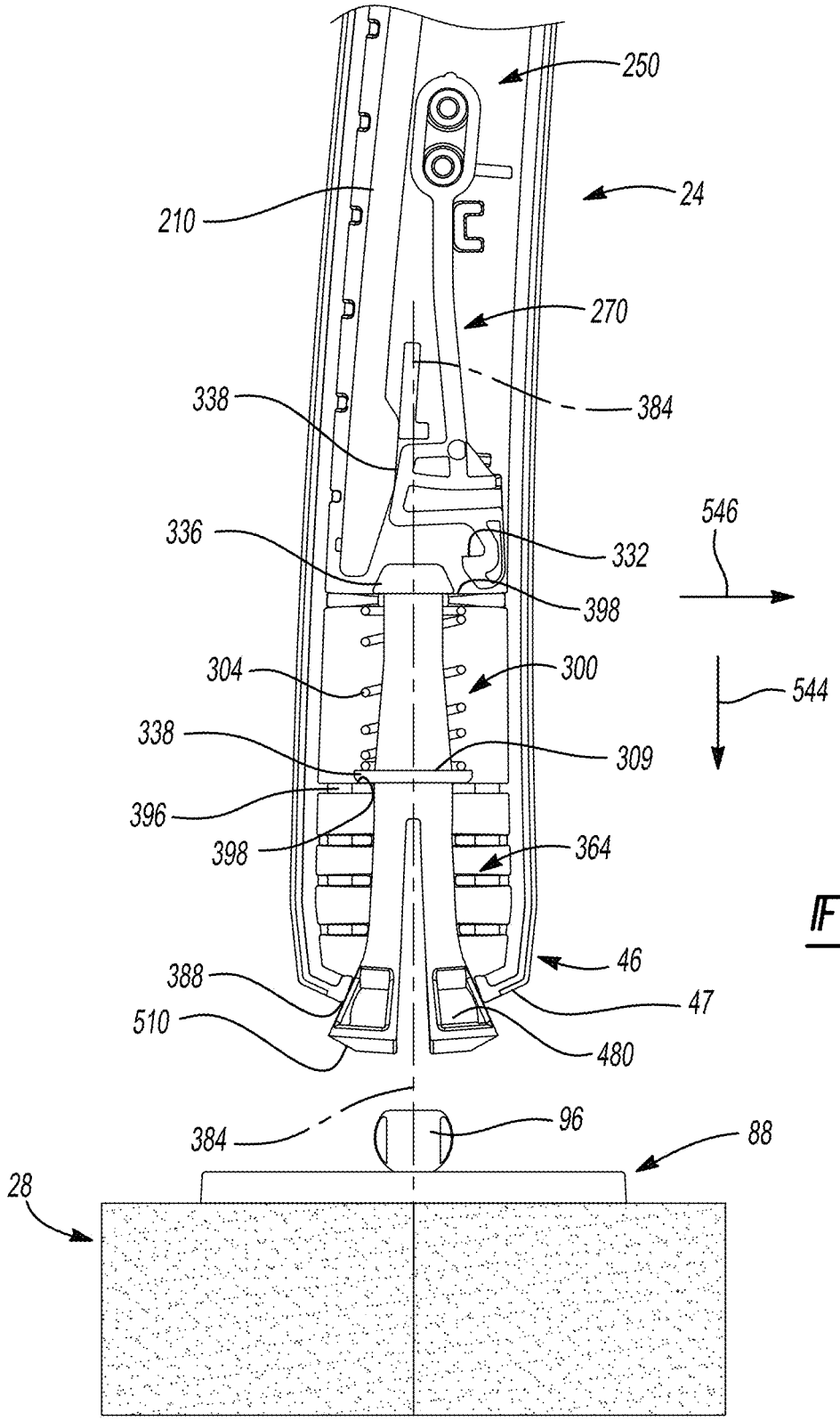

Turning reference to FIG. 18, the attachment mechanism 250 may be operated to disengage or remove the head assembly 28 from the handle assembly 24. As discussed above, the control button 40 may be moved to overcome the biasing member 280 to move the latch release 210 to move the latch 270 generally in the direction of arrow 546 to disengage the catch finger surface 332 from the collet projection 336. The biasing member 304, as discussed above, may then bias or move the collet assembly 300 generally in the direction of arrow 544. Due to the spring force or force provided by the biasing member 304, such as against the collet projection 309 and the projection 398, the collet assembly 300 may move with a selected force against the head assembly 28 and relative to the handle assembly 24. Accordingly, the head assembly 28 may also generally move in the direction of arrow 544 without additional force applied by a user. The biasing force of the biasing member 304 may move the collet 300 to move the head assembly 28 generally in the direction of arrow 544 away from the collet 300, and generally along the axis 384, at least initially. Further, as the collet 300 is moved generally in the direction of arrow 544, the fingers 372-380 may generally move laterally relative to the long central axis 384 to disengage the connection member 96. Thus, the head assembly 28 may be substantially forcibly ejected due to biasing member 312 bias toward the distal end 46 or removed from the handle assembly 24. Thereafter, the user may release the control button 40 and the biasing member 280 may move the release portion or surface 258 away from the latch 270 and allow the latch to relax, as discussed above. The collet latch surface 550 may engage a side of the projection 398 to limit travel of the collet 300 and maintain the collet 300 within the handle assembly 24. The biasing member 304 may continue to hold the collet 300 in the ready position to receive a further or additional head assembly 28.

In light of the above, therefore, the handle assembly 24 with the connection mechanism 250 may be used to engage the head assembly 28 for selected use while allowing movement of the head assembly 28 relative to the handle assembly. The connection mechanism 250 may be actuated with a selected actuation portion or assembly that may include all of parts of the control button 40, the release latch 210, and the release assembly 270. The actuation assembly may be operated by a user to disengage or uncouple of the head assembly 28 (e.g., the connection member 96 of the fitment 88) from the handle assembly 24. Further, the plunger 308 or selected portion of the connection mechanism 250 may hold the head assembly 28 in a selected position, such as substantially perpendicular, relative to the central axis 384. At a selected time the connection mechanism 250 may be released or unlatched and the head 28 may be forcibly disengaged from the handle assembly 24, including the collet 300, due to the various biasing spring forces.

Further areas of applicability of the present teachings will become apparent from the detailed description provided above. It should be understood that the detailed description and specific examples, while indicating various embodiments, are intended for purposes of illustration only and are not intended to limit the scope of the teachings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cleaning tool assembly comprising:

a. an elongated handle extending from a first end to a second end having an external second end surface;

b. an actuation assembly housed within the elongated handle and configured to be operated by a user;

C. a cleaning head having a fitment, the fitment comprising, i. a base having a first surface configured to contact a cleaning substrate and a second opposed surface, ii. a connection member extending from the second opposed surface of the base having a base connection portion that connects the connection member to the base; and iii. a proximal surface opposite the base connection portion that contacts a selected portion of the actuation assembly;

and d. a collet having (i) an expandable collar configured to selectively couple to the connection member or decouple from the connection member by movement of the actuation assembly and (ii) defining a central axis;

wherein the actuation assembly is moveable within the elongated handle to move the collet to selectively couple the fitment in a coupled configuration or decouple the fitment in a decoupled configuration;

wherein the collet is biased in the decoupled configuration;

wherein the external second end surface defines an internal angle less than 90 degrees relative to the central axis;

wherein the cleaning head is configured to tilt relative to the elongated handle such that at least the second opposed surface is configured to move from about 1 degree to about 50 degrees relative to the external second end surface and the cleaning head is configured to rotate relative to the elongated handle when selectively coupled.

2. The cleaning tool assembly of claim 1, wherein the elongated handle further comprises a separate first portion having an engaging portion with a projection that is connected to a separate second portion at a connection portion;

wherein the actuation assembly is housed and moveable entirely in the second portion;

wherein an assembly with the connection of the separate first portion to the separate second portion is substantially permanent.

3. The cleaning tool assembly of claim 1, wherein the actuation assembly comprises a first biasing member configured to move the collet to decouple the connection member.

4. The cleaning tool assembly of claim 3, wherein the actuation assembly comprises a latch configured to engage the collet to hold the collet in a coupled configuration to couple the fitment.

5. The cleaning tool assembly of claim 4, wherein the actuation assembly comprises an unlatching member moveable by the user within the elongated handle to disengage the latch.

6. The cleaning tool assembly of claim 5, wherein the unlatching member has a second biasing member to bias the unlatching member toward the first end of the elongated handle.

7. The cleaning tool assembly of claim 3, wherein the actuation assembly comprises a plunger configured to engage the connection member.

8. The cleaning tool assembly of claim 7, wherein the proximal surface engages a portion of the plunger to position the base substantially perpendicular to the central axis.

9. The cleaning tool assembly of claim 8, wherein the collet further comprises a spur extending from a finger of the collet toward the central axis to engage the proximal surface in the coupled configuration.

10. The cleaning tool assembly of claim 7, wherein the proximal surface of the connection member has a proximal end surface operable to allow movement of the base at an angle relative to the central axis.

11. The cleaning tool assembly of claim 1, wherein the first surface of the base is operable to tilt to define an internal angle of at least about 70 degrees to about 50 degrees between the first surface of the base and a longitudinal axis of the elongated handle and rotate at least 180 degrees around the longitudinal axis of the elongated handle.

12. The cleaning tool assembly of claim 11, wherein the collet retracts into the elongated handle to move into the coupled configuration.

13. The cleaning tool assembly of claim 1, wherein the connection member defines a depression formed within the connection member and extending through the proximal surface.

14. A cleaning tool assembly comprising:

a. an elongated handle extending from a first end to a second end having an external second end surface;

b. a cleaning head having a fitment, the fitment comprising, i. a base having a first surface configured to contact a cleaning substrate and a second opposed surface, ii. a connection member having an outer surface portion, wherein the outer surface portion extends from a base connection portion that connects the connection member to the base; and iii. a proximal end surface opposite the base connection portion;

c. an actuation assembly housed within the elongated handle and configured to be operated by a user; and d. a collet with an expandable collar configured to selectively couple to the connection member or decouple from the connection member by movement of the actuation assembly, wherein the collet defines a central axis;

wherein the collet is moveable within the elongated handle to selectively couple the fitment in a coupled configuration or decouple the fitment in a decoupled configuration;

wherein the collet is biased in the decoupled configuration;

wherein the actuation assembly is moveable within the elongated handle to move the collet to selectively decouple the fitment;

wherein the cleaning head is configured to tilt relative to the central axis such that at least the second opposed surface is configured to move from about 1 degree to about 50 degrees relative to the external second end surface and the cleaning head is configured to rotate relative to the collet in the coupled configuration.

15. The cleaning tool assembly of claim 14, wherein the actuation assembly comprises a biasing member configured to move the collet to decouple the connection member.

16. The cleaning tool assembly of claim 14, wherein the actuation assembly comprises a latch configured to engage the collet to hold the collet in a coupled configuration to couple the fitment.

17. The cleaning tool assembly of claim 14, wherein the actuation assembly comprises a plunger configured to engage the connection member.

18. The cleaning tool assembly of claim 17, wherein the proximal end surface is a planar surface and engages a portion of the plunger to position the base substantially perpendicular to the central axis.

19. A cleaning tool assembly comprising:

a. an elongated handle having at least two selectively couplable portions including a separate proximal portion having a first proximal end and a first distal end and a separate distal portion having a second proximal end and a second distal end, wherein the separate proximal portion at the first proximal end is selectively coupled to the separate distal portion at the second distal end at a connection portion, wherein the elongated handle in an assembled configuration extends from the first proximal end to the second distal end;

b. a cleaning head having a fitment, the fitment comprising, i. a base having a first surface configured to contact a cleaning substrate and a second opposed surface, ii. a connection member having a substantially spherical outer surface portion and a planar end surface, wherein the substantially spherical outer surface portion extends from a base connection portion, wherein the base connection portion connects the connection member to the second opposed surface such that the planar end surface is opposite the base connection portion;

c. an actuation assembly housed only within the distal portion of the elongated handle and configured to be operated by a user, wherein the actuation assembly comprises a latch and a biasing member; and d. an engagement member with an expandable collet configured to selectively couple to the connection member in a coupled configuration or decouple from the connection member in a decoupled configuration by movement of the actuation assembly;

wherein the collet includes (i) at least a first finger and a second finger that are formed in a biased decoupled configuration and (ii) a spur extending toward a central axis to engage the planar end surface in the coupled configuration;

wherein an exterior surface of at least the first finger and the second finger engage an internal surface of the elongated handle to achieve the coupled configuration;

wherein the cleaning head is operable to rotate and tilt relative to the central axis when the collet is in the coupled configuration and coupled to the fitment;

wherein the actuation assembly is moveable only within the distal portion of the elongated handle to move the engagement member to selectively decouple the fitment by releasing the latch to allow the biasing member to move the engagement member to a decoupled configuration;

wherein the actuation assembly comprises a plunger configured and moveable to engage the connection member.

20. The cleaning tool assembly of claim 19, wherein the second distal end of the distal portion includes an end surface;

wherein the cleaning head is configured to tilt relative to the elongated handle such that at least the second opposed surface is operable to move to define an angle of about 50 degrees between the end surface and the second opposed surface and the cleaning head is configured to rotate relative to the elongated handle when selectively coupled.

21. The cleaning tool assembly of claim 19, wherein the elongated handle is configured to be formed by the substantially permanent coupling of the proximal portion and the distal portion.

* * * * *